US010807363B2

(12) United States Patent
Naganuma

(10) Patent No.: US 10,807,363 B2
(45) Date of Patent: Oct. 20, 2020

(54) LIQUID EJECTING HEAD AND LIQUID EJECTING APPARATUS

(71) Applicant: Seiko Epson Corporation, Tokyo (JP)

(72) Inventor: Yoichi Naganuma, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/446,720

(22) Filed: Jun. 20, 2019

(65) Prior Publication Data

US 2019/0389216 A1 Dec. 26, 2019

(30) Foreign Application Priority Data

Jun. 21, 2018 (JP) ..... 2018-117506

(51) Int. Cl.
*B41J 2/14* (2006.01)

(52) U.S. Cl.
CPC ..... *B41J 2/14233* (2013.01); *B41J 2/1433* (2013.01); *B41J 2002/14419* (2013.01)

(58) Field of Classification Search
CPC ..... B41J 2/14233; B41J 2/1433; B41J 2002/14419; B41J 2002/14241; B41J 2002/14491; B41J 2202/11; B41J 2/1607; B41J 2/1623; B41J 2/1629; B41J 2/1631; B41J 2/1634; B41J 2/1645; B41J 2/1646
See application file for complete search history.

(56) References Cited

U.S. PATENT DOCUMENTS 9,180,669 B2 * 11/2015 Kinoshita ..... B41J 2/14233
2015/0035910 A1 2/2015 Kinoshita et al.

FOREIGN PATENT DOCUMENTS

JP 2015-030153 A 2/2015

OTHER PUBLICATIONS

IP.com search (Year: 2020).*

* cited by examiner

*Primary Examiner* — Lisa Solomon
(74) *Attorney, Agent, or Firm* — Harness, Dickey & Pierce, P.L.C.

(57) ABSTRACT

A liquid ejecting head includes a nozzle plate, a multilayer substrate, and a pressure chamber substrate. The multilayer substrate includes a communication flow path penetrating a first flow path arrangement layer, a insulating layer, and a second flow path arrangement layer. When a direction from the pressure chamber substrate toward the nozzle plate is defined as a first direction, and a direction intersecting the first direction is defined as a second direction, the communication flow path includes a first portion having a first width and a second portion having a second width in a first cross section along the first direction and the second direction, the first width is narrower than the second width, the first portion includes the insulating layer, and the communication flow path includes a first inclined portion having a wall surface inclined to the first direction between the first portion and the second portion.

10 Claims, 23 Drawing Sheets

LIQUID EJECTING HEAD AND LIQUID EJECTING APPARATUS

The present application is based on, and claims priority from, JP Application Serial Number 2018-117506, filed Jun. 21, 2018, the disclosure of which is hereby incorporated by reference herein in its entirety.

BACKGROUND

1. Technical Field

The present disclosure relates to a liquid ejecting head and a liquid ejecting apparatus.

2. Related Art

For example, the liquid ejecting head described in JP-A-2015-30153 has a structure in which a nozzle plate having a nozzle, a flow path substrate having a communication flow path coupled to the nozzle of the nozzle plate, and a pressure chamber substrate having a pressure chamber coupled to the communication flow path of the flow path substrate are laminated in order. The communication flow path described in JP-A-2015-30153 has a straight hole shape for allowing the pressure chamber and the nozzle to communicate with each other. The liquid ejecting head ejects a liquid droplet from the nozzle by causing a pressure change in the liquid in the pressure chamber.

In the above-described liquid ejecting head, a plurality of combinations of the pressure chamber, the communication flow path, and the nozzle are provided. When the density of the nozzles increases with the increase in the accuracy of a liquid ejecting apparatus, the walls partitioning the communication flow paths become thinner, and the walls are likely to be bent by the pressure of the liquid in the communication flow paths. When the wall between the communication flow paths is likely to be bent, a crosstalk phenomenon is likely to occur, in which whether or not liquid droplets are ejected from the adjacent nozzles affects the ejection of the liquid droplets. When the crosstalk phenomenon occurs, the landing positions of the liquid droplets vary.

In order to suppress the crosstalk phenomenon, it is necessary to increase the rigidity of the wall of the communication flow path. In such a case, when a bubble remains in the communication flow path, it affects the ejection of the liquid droplets, and therefore it is necessary to suppress residual bubbles in the communication flow path.

SUMMARY

A liquid ejecting head according to an aspect of the present disclosure includes a nozzle plate that includes a nozzle, a multilayer substrate that includes a first flow path arrangement layer, an insulating layer having a material different from a material forming the first flow path arrangement layer, and a second flow path arrangement layer having a material different from a material forming the insulating layer in order of arrangement from a side of the nozzle plate, and that includes a communication flow path penetrating the first flow path arrangement layer, the insulating layer, and the second flow path arrangement layer, and a pressure chamber substrate that includes a pressure chamber communicating with the nozzle via the communication flow path, in which when a direction from the pressure chamber substrate toward the nozzle plate is defined as a first direction, and a direction intersecting the first direction is defined as a second direction, the communication flow path includes a first portion having a first width and a second portion having a second width in a first cross section along the first direction and the second direction, the first width is narrower than the second width, the first portion includes the insulating layer, and the communication flow path includes a first inclined portion having a wall surface inclined to the first direction between the first portion and the second portion.

In addition, a liquid ejecting apparatus of the present disclosure has an aspect that includes the liquid ejecting head.

DESCRIPTION OF EXEMPLARY EMBODIMENTS

Figure 1:
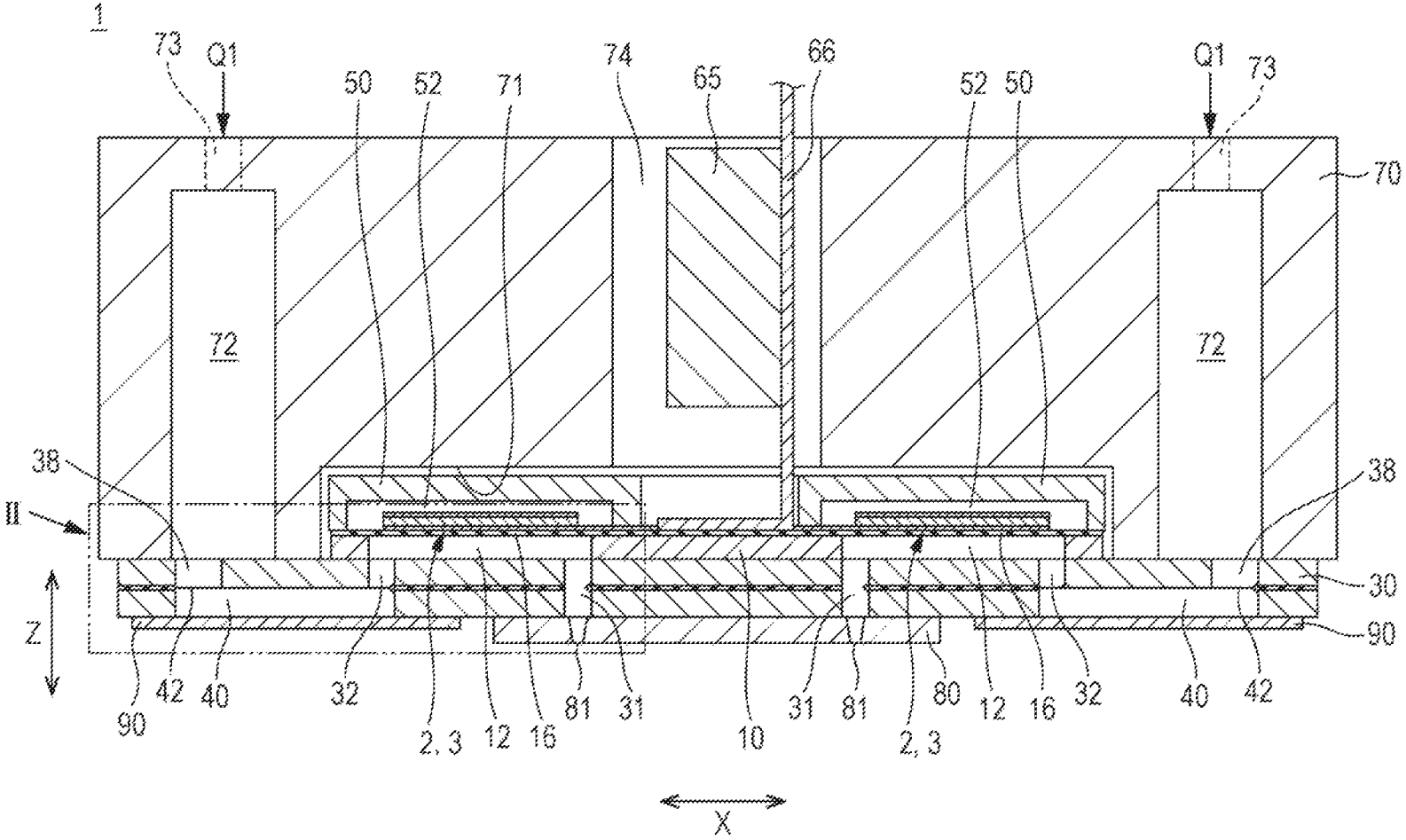
FIG. 1 is a view schematically illustrating an example of a liquid ejecting head in a cross section along an X direction and a Z direction.

Hereinafter, embodiments of the present disclosure will be described. As a matter of course, the following embodiments merely exemplify the present disclosure, and not all of the features described in the embodiments are necessarily essential to the solution means of the disclosure.

(1) OUTLINE OF TECHNOLOGY INCLUDED IN PRESENT DISCLOSURE

First, an outline of the technology included in the present disclosure will be described with reference to the examples illustrated in FIGS. 1 to 24. The drawings of the present application are views schematically illustrating examples, the enlargement ratios in the respective directions illustrated in these drawings may be different from each other, and the respective drawings may not be matched in some cases. As matter of course, each element of the present technology is not limited to a specific example indicated by a reference numeral.

In addition, in the present application, the numerical range "Min to Max" means the minimum value Min or more and the maximum value Max or less. The compositional ratio represented by the chemical formula represents the stoichiometric ratio, and substances represented by the chemical formula include those deviating from the stoichiometric ratio.

Aspect 1

A liquid ejecting head 1 according to an aspect of the present technology includes a nozzle plate 80, a multilayer substrate 30, and a pressure chamber substrate 10. The nozzle plate 80 has a nozzle 81. The multilayer substrate 30 includes a first flow path arrangement layer 131, an insulating layer 141 having a material different from a material forming the first flow path arrangement layer 131, and a second flow path arrangement layer 132 having a material different from a material forming the insulating layer 141 in order of arrangement from a side of the nozzle plate 80. The multilayer substrate 30 has a communication flow path 31 that penetrates the first flow path arrangement layer 131, the insulating layer 141, and the second flow path arrangement layer 132. The pressure chamber substrate 10 has a pressure chamber 12 communicating with the nozzle 81 via the communication flow path 31.

Here, a direction from the pressure chamber substrate 10 toward the nozzle plate 80 is defined as a first direction D1, and a direction intersecting the first direction D1 is defined as a second direction D2. As exemplified in FIG. 5 and the like, the communication flow path 31 includes a first portion 310 having a first width W1 and a second portion 320 having a second width W2 in a first cross section SC1 along the first direction D1 and the second direction D2. The first width W1 is narrower than the second width W2. The first portion 310 includes the insulating layer 141. The communication flow path 31 includes a first inclined portion 340 having a wall surface inclined to the first direction D1 between the first portion 310 and the second portion 320.

In the above-described aspect 1, the width of the communication flow path 31 in the first cross section SC1 is narrower in the first portion 310 including the insulating layer 141 than in the second portion 320, and therefore the rigidity of the wall of the communication flow path 31 is enhanced. In addition, since the first inclined portion 340 is provided between the first portion 310 and the second portion 320 in the communication flow path 31, the flow of a liquid Q1 improves and the residual bubbles in the communication flow path 31 are suppressed. Therefore, according to this aspect, it is possible to provide the liquid ejecting head which improves a discharge performance of the bubbles of the communication flow path while increasing the rigidity of the wall of the communication flow path.

As a result, when a plurality of nozzles are arranged on the nozzle plate, the rigidity of the wall between the communication flow paths is enhanced, and the discharge performance of the bubbles in the communication flow path can be improved while suppressing the crosstalk phenomenon.

Here, the nozzle is a small hole from which a liquid droplet such as an ink droplet is ejected.

As the material forming the first flow path arrangement layer and the second flow path arrangement layer, a semiconductor such as silicon, metal, ceramics, or the like can be used. As the material forming the insulating layer, a material different from the materials forming the first flow path arrangement layer and the second flow path arrangement layer can be used from among silicon oxide, metal oxide, ceramics, synthetic resin, and the like. For example, when an SOI substrate is used for the multilayer substrate, an insulating layer can be formed from the silicon oxide layer and the first flow path arrangement layer and the second flow path arrangement layer can be formed from silicon layers on both sides of the above-described silicon oxide layer. Here, SOI is an abbreviation for "silicon on insulator".

The insulating layer of the multilayer substrate is not limited to one layer and may be two or more layers. The communication flow path of the multilayer substrate may penetrate an additional layer when the multilayer substrate includes the additional layer such as a third flow path arrangement layer.

The pressure chamber is a space for applying pressure to the liquid in the inside.

The fact that the wall surface of the first inclined portion is inclined to the first direction means that the wall surface of the first inclined portion is not along the first direction and the wall surface of the first inclined portion is not orthogonal to the first direction. The inclined wall surface of the communication flow path may be located between the first portion and the second portion having different widths from each other in the first cross section. Therefore, in a cross section along the first direction and not along the second direction, there may be no inclined wall surface in the communication flow path, or there may be an inclined wall surface in the communication flow path. The liquid ejecting head is also called a liquid discharge head.

The above-described appendix also applies to the following aspects.

Aspect 2

Figure 5:
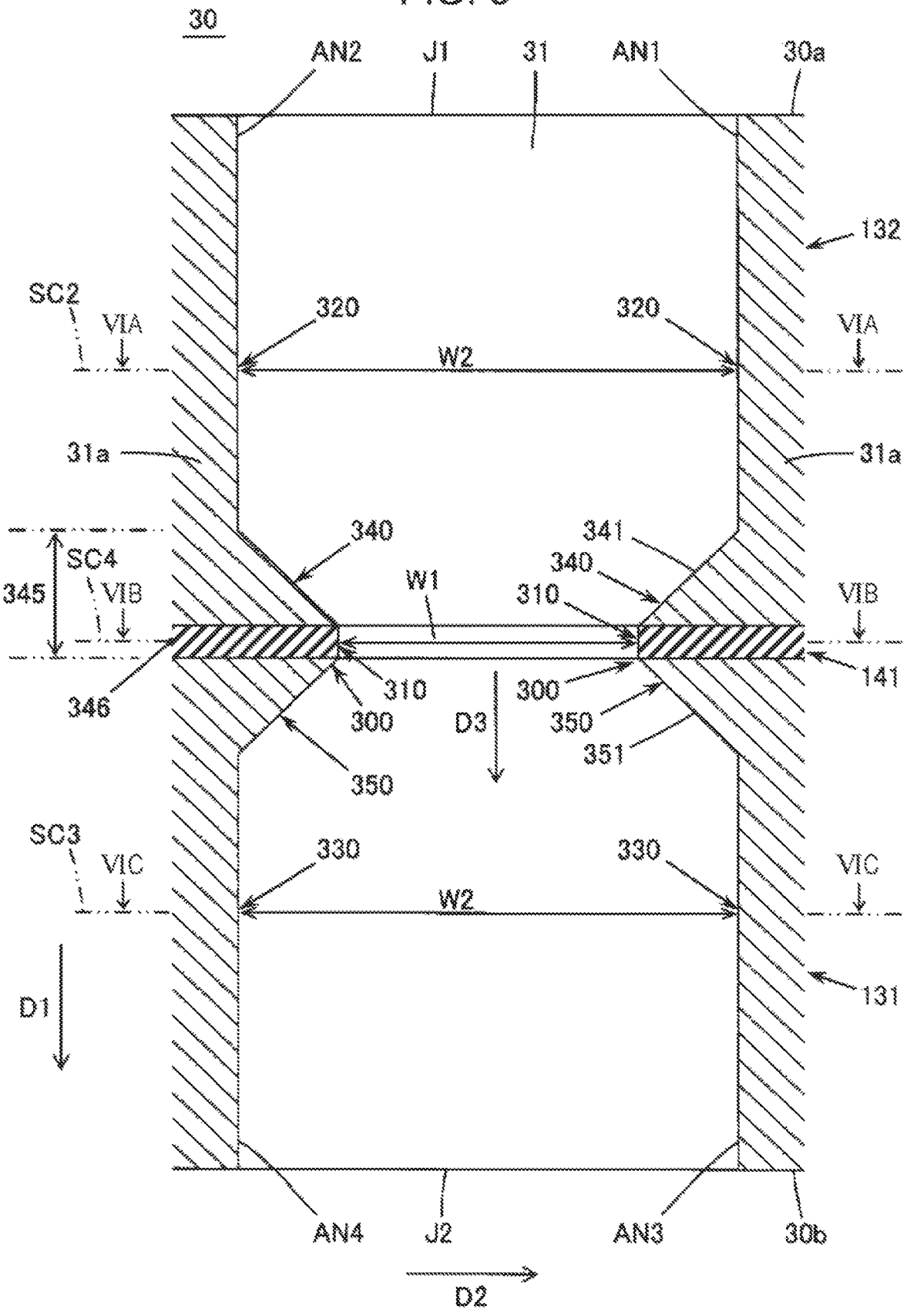
FIG. 5 is a view schematically illustrating an example of a cross section of the multilayer substrate at a position of V-V in FIG. 4.
Figure 6A:
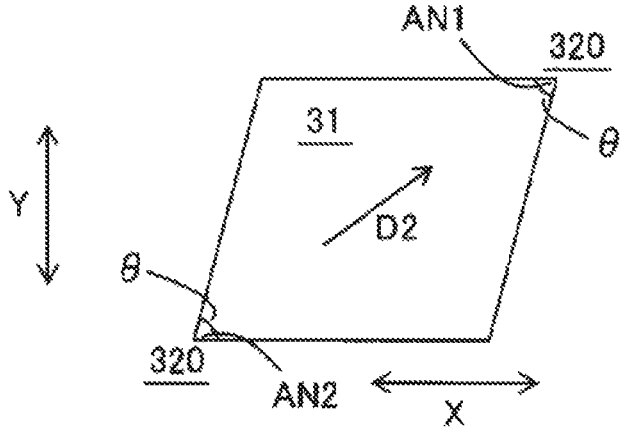
FIG. 6A is a view schematically illustrating an example of a cross section of a communication flow path at a position of VIA-VIA in FIG. 5.
Figure 6B:
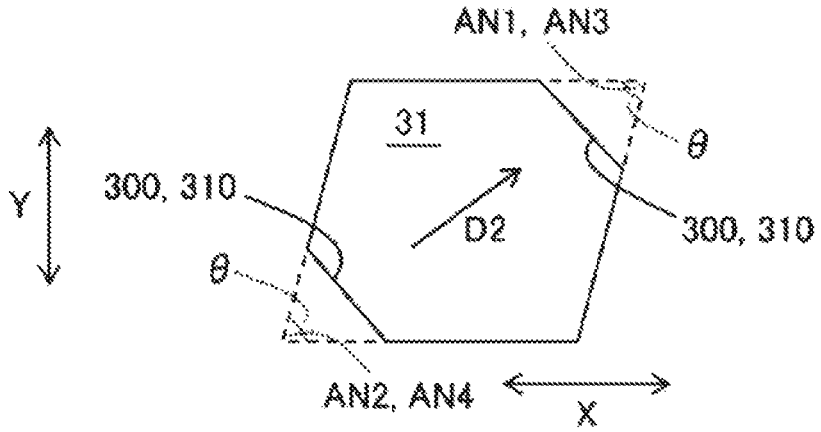
FIG. 6B is a view schematically illustrating an example of a cross section of the communication flow path at a position of VIB-VIB in FIG. 5.
Figure 6C:
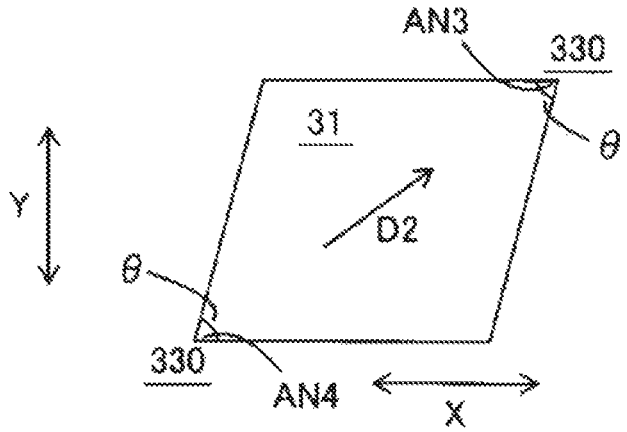
FIG. 6C is a view schematically illustrating an example of a cross section of the communication flow path at a position of VIC-VIC in FIG. 5.

As exemplified in FIG. 5 and the like, the communication flow path 31 may include a third portion 330 in a direction D3 opposite to the second portion 320 from the first portion 310. As exemplified in FIG. 6A, a shape of the second portion 320 in a second cross section SC2 orthogonal to the first direction D1 may have a first angle AN1 and a second angle AN2 facing the first angle AN1. As illustrated in FIG. 6C, a shape of the third portion 330 in a third cross section SC3 orthogonal to the first direction D1 may have a third angle AN3 corresponding to the first angle AN1 and a fourth angle AN4 corresponding to the second angle AN2. The first inclined portion 340 may be disposed between the first angle AN1 and the third angle AN3.

In the above aspect, since the first inclined portion 340 is located at a position corresponding to the first angle AN1 and the third angle AN3 when the communication flow path 31 is viewed from the first direction D1, the residual bubbles in the communication flow path 31 are further suppressed. Therefore, according to this aspect, it is possible to provide a technology for further improving the discharge performance of the bubbles of the communication flow path.

Aspect 3

Furthermore, a plurality of first inclined portions 340 may be provided. The plurality of first inclined portions 340 may be arranged between the first angle AN1 and the third angle AN3, and between the second angle AN2 and the fourth angle AN4. In this aspect, when the communication flow path 31 is viewed from the first direction D1, since the first inclined portions 340 are located at the position corresponding to the first angle AN1 and the third angle AN3, and the position corresponding to the second angle AN2 and the fourth angle AN4, the rigidity of the wall of the communication flow path 31 is increased in a state where the residual bubbles in the communication flow path 31 are suppressed. Therefore, according to this aspect, it is possible to provide a technology capable of further increasing the rigidity of the wall of the communication flow path.

Aspect 4

Furthermore, the first angle AN1, the second angle AN2, the third angle AN3, and the fourth angle AN4 may be acute angles. In this aspect, when the communication flow path 31 is viewed from the first direction D1, since the first inclined portion 340 is located at the position corresponding to the first angle AN1 and the third angle AN3 which have the acute angles, or the position corresponding to the second angle AN2 and the fourth angle corresponding to AN4 which have the acute angles, the residual bubbles in the communication flow path 31 are further suppressed. Therefore, according to this aspect, it is possible to provide a technology for further improving the discharge performance of the bubbles of the communication flow path.

Aspect 5

The above-described first inclined portion 340 may be separated from a first coupling portion J1 between the communication flow path 31 and the pressure chamber 12, and may be separated from a second coupling portion J2 between the communication flow path 31 and the nozzle 81. In this aspect, since the first inclined portion 340 is disposed in a portion of the wall of the communication flow path 31 which is likely to be bent, the rigidity of the wall of the communication flow path is further increased.

Aspect 6

As exemplified in FIG. 5 and the like, a range 345 from the first portion 310 to the first inclined portion 340 in the communication flow path 31 may include an intermediate position 346 in the first direction D1 in the communication flow path 31. In this aspect, since the first portion 310 and the first inclined portion 340 are disposed in the particularly easily bendable portion of the wall of the communication flow path 31, the rigidity of the wall of the communication flow path is further increased.

Aspect 7

The first flow path arrangement layer 131 and the second flow path arrangement layer 132 may be made of silicon. A plane index of a front surface of the multilayer substrate 30 may be (110). A plane index of a wall surface of the first inclined portion 340 may be (111). According to this aspect, it is possible to provide a suitable liquid ejecting head which improves the discharge performance of the bubbles of the communication flow path while increasing the rigidity of the wall of the communication flow path.

Here, the plane index is also called Miller index. A surface whose plane index is (110) is also called a (110) plane. A surface whose plane index is (111) is also called a (111) plane.

Aspect 8

As exemplified in FIG. 5 and the like, the communication flow path 31 may include the third portion 330 in the direction D3 opposite to the second portion 320 from the first portion 310. The first portion 310 may protrude inside the communication flow path 31 compared with the second portion 320 and the third portion 330. The communication flow path 31 may include a second inclined portion 350 having a wall surface inclined to the first direction D1 between the first portion 310 and the third portion 330. According to this aspect, it is possible to provide the suitable liquid ejecting head which improves the discharge performance of the bubbles of the communication flow path while increasing the rigidity of the wall of the communication flow path.

Aspect 9

Figure 2:
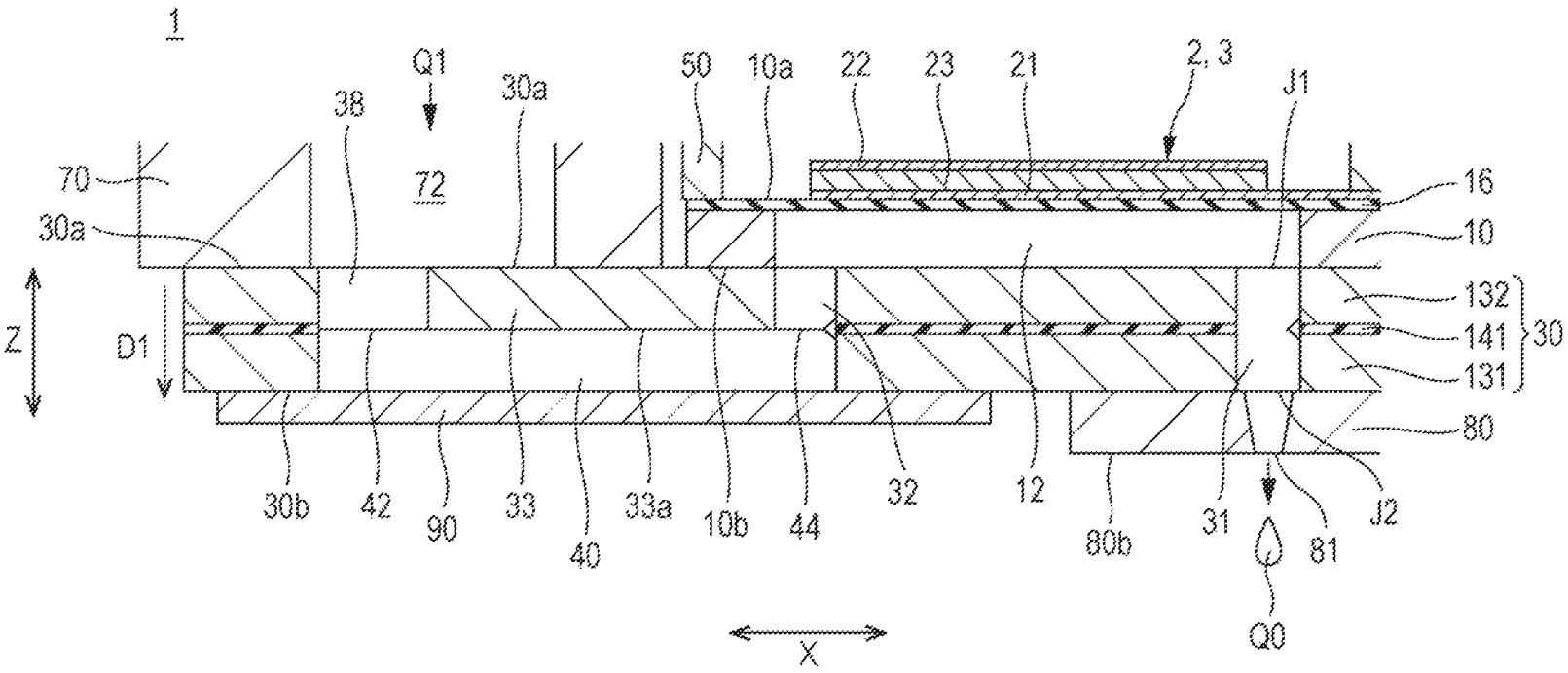
FIG. 2 is an enlarged cross-sectional view of a portion II in FIG. 1.
Figure 3:
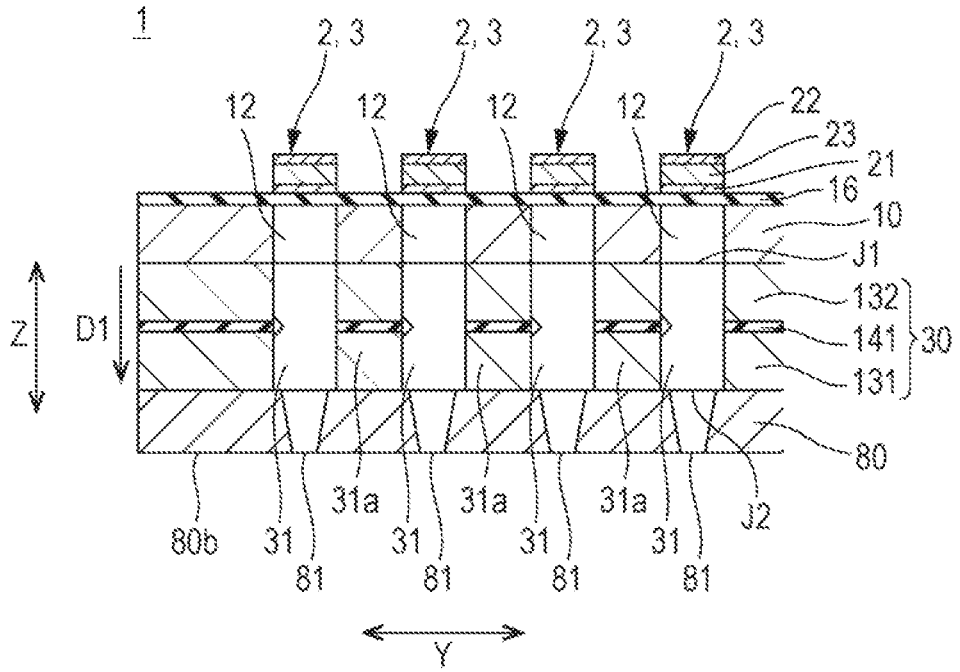
FIG. 3 is a view schematically illustrating an example of the liquid ejecting head in a cross section along a Y direction and the Z direction.

As exemplified in FIGS. 1 to 3, the pressure chamber substrate 10 may include a vibration plate 16 including a portion of the wall of the pressure chamber 12 or may include a piezoelectric element 3 disposed on the vibration plate 16. According to this aspect, it is possible to provide the suitable liquid ejecting head which improves the discharge performance of the bubbles of the communication flow path while increasing the rigidity of the wall of the communication flow path.

Aspect 10

Figure 16:
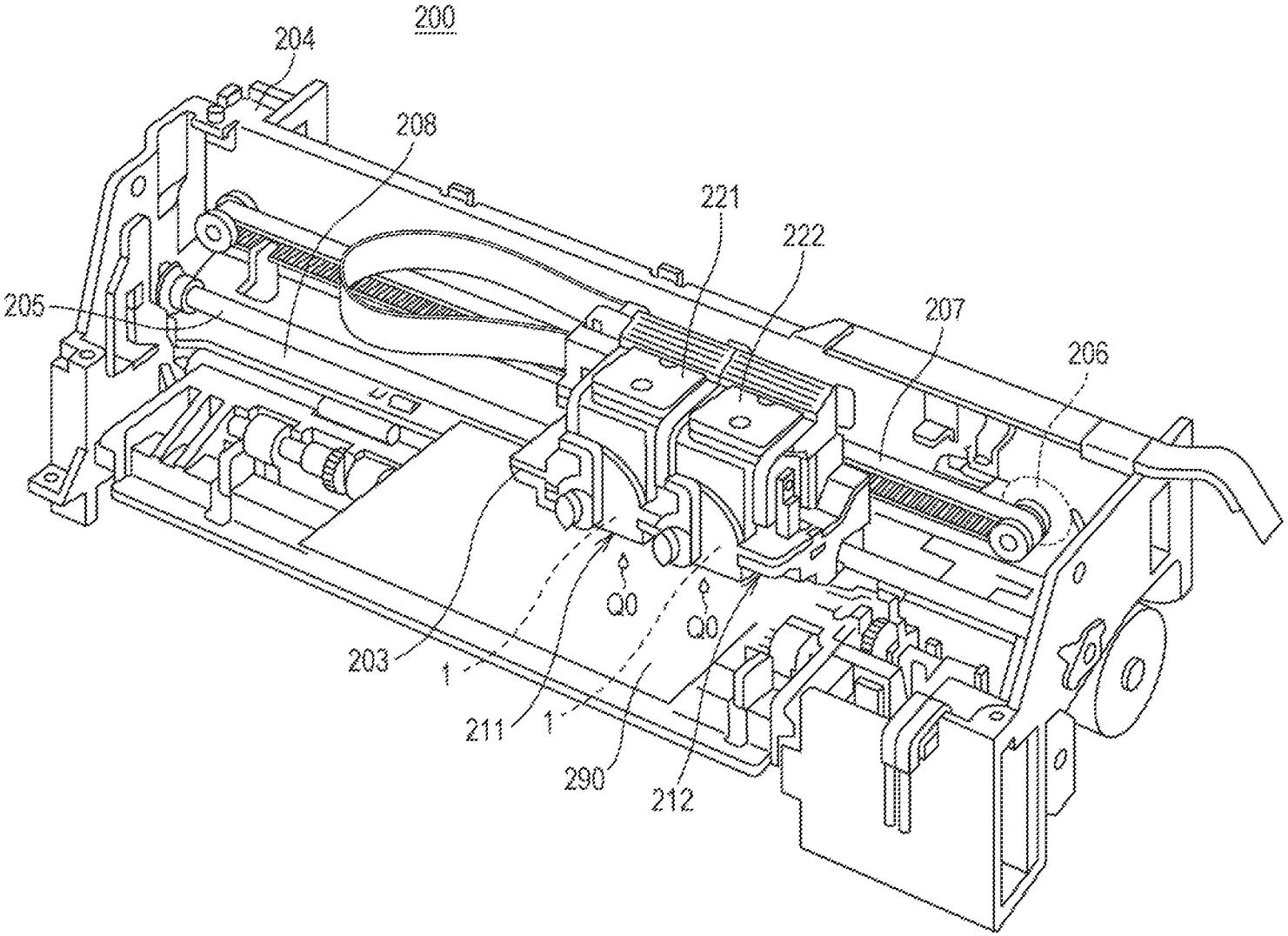
FIG. 16 is a perspective view schematically illustrating an example of a liquid ejecting apparatus having the liquid ejecting head.

As exemplified in FIG. 16, a liquid ejecting apparatus 200 according to an aspect of the present technology includes the above-described liquid ejecting head 1. According to this aspect, it is possible to provide the liquid ejecting apparatus including the liquid ejecting head which improves the discharge performance of the bubbles of the communication flow path while increasing the rigidity of the wall of the communication flow path. As a result, when the plurality of nozzles are arranged on the nozzle plate, the rigidity of the wall between the communication flow paths is enhanced, and the discharge performance of the bubbles in the communication flow path can be improved while suppressing the crosstalk phenomenon.

Here, the liquid ejecting apparatus is also referred to as a liquid discharge apparatus.

Furthermore, the present technology also has aspects such as a manufacturing method of the multilayer substrate, a manufacturing method of the liquid ejecting head, a manufacturing method of the liquid ejecting apparatus, and the like.

(2) SPECIFIC EXAMPLE OF LIQUID EJECTING HEAD

FIG. 1 schematically illustrates an ink jet type recording head as an example of the liquid ejecting head 1 in a cross section along the X direction and the Z direction. FIG. 2 is an enlarged view of the portion II in FIG. 1. FIG. schematically illustrates the liquid ejecting head 1 illustrated in FIG. 1 in a cross section along the Y direction and the Z direction. Here, the X direction is a direction included in the direction along the multilayer substrate 30, directions of the pressure chamber substrate 10, the multilayer substrate 30, the nozzle plate 80, and a sealing plate 90 in the width direction, and a direction of the pressure chamber 12 in the longitudinal direction. The Y direction is a direction included in the direction along the multilayer substrate 30, directions of the pressure chamber substrate 10, the multilayer substrate 30, the nozzle plate 80, and the sealing plate 90 in the longitudinal direction, and a direction where the communication flow path 31, the nozzle 81, and a supply flow path 32 are arranged. The Z direction illustrates directions of the pressure chamber substrate 10, the multilayer substrate 30, the nozzle plate 80, and the sealing plate 90 in the thickness direction. Reference numeral D1 is a first direction from the pressure chamber substrate 10 to the nozzle plate 80. The first direction D1 of the specific example is aligned with the Z direction.

The X direction, the Y direction, and the Z direction are orthogonal to each other, and these directions are also included in the present technology as long as these directions intersect with each other even when these directions are not orthogonal due to design or the like. The fact of "orthogonal" is not limited to strict 90°, and includes deviation from strict 90° due to error. In addition, the same in direction, position, and the like are not limited to strict matching, and includes deviation from strict matching due to error. Furthermore, the description of the positional relationship of each part is merely an example. Therefore, it is also included in the present technology to change a left-right direction to an up-down direction or a front-rear direction, to change the up-down direction to the left-right direction or the front-rear direction, to change the front-rear direction to the left-right direction or the up-down direction, and the like.

The liquid ejecting head 1 illustrated in FIG. 1 or the like is provided with the pressure chamber substrate 10, the multilayer substrate 30, a protective substrate 50, a case head 70, the nozzle plate 80, the sealing plate 90, and the like. A reservoir of the liquid ejecting head 1 includes a so-called vertical shape and includes a first common liquid chamber 40 in the multilayer substrate 30 and a second common liquid chamber 72 in the case head 70. Hereinafter, the first common liquid chamber is simply referred to as "common liquid chamber".

The pressure chamber substrate 10 has the pressure chamber 12 corresponding to each nozzle 81, an actuator 2 on a protective substrate side surface 10*a*, and an opening of the pressure chamber 12 on a multilayer substrate side surface 10*b*. The pressure chamber substrate 10 has two rows of pressure chambers in which multiple pressure chambers 12 are arranged in the Y direction which is the arrangement direction of the nozzles 81. That is, in the pressure chamber substrate 10, two pressure chambers 12 are disposed in the X direction which is the longitudinal direction of the pressure chamber 12. As matter of course, in addition to having two rows of pressure chambers, the pressure chamber substrate may have one row of pressure chamber or three or more rows of pressure chambers. The multilayer substrate side surface 10*b* is bonded to a pressure chamber substrate side surface 30*a* of the multilayer substrate 30. The pressure chamber substrate 10 and the multilayer substrate 30 are bonded to each other by an adhesive, for example. In the present specification, the bonding and contacting includes both presence of intervening material such as an adhesive therebetween, and absence of intervening material therebetween.

For example, the pressure chamber 12 is formed in a substantially quadrangular shape elongated in a plan view as viewed from the protective substrate side surface 10*a* with respect to the pressure chamber substrate 10, and pressure chambers 12 are disposed in the Y direction with the partition wall therebetween. Each pressure chamber 12 communicates with the nozzle 81 of the nozzle plate 80 via the communication flow path 31 of the multilayer substrate 30.

As the material forming the pressure chamber substrate 10 except for the actuator 2, a silicon substrate, a metal such as SUS, ceramics, glass, a synthetic resin, or the like can be used. Here, SUS is an abbreviation of stainless steel. Although not particularly limited, the pressure chamber substrate 10 can be formed of a silicon single crystal substrate having a relatively large film thickness of, for example, approximately several hundred μm and high rigidity. The pressure chambers 12 partitioned by the plurality of partition walls can be formed by anisotropic wet etching, using an alkaline solution such as KOH aqueous solution, for example.

The actuator 2 illustrated in FIGS. 1 to 3 includes the vibration plate 16 disposed on substantially the entire surface of the protective substrate side surface 10*a* of the pressure chamber substrate 10, and the piezoelectric element 3 disposed on the vibration plate 16. The vibration plate 16 is a wall on the side of the piezoelectric element 3 of the wall of the pressure chamber 12. Therefore, the vibration plate 16 includes a portion of the wall of the pressure chamber 12. The pressure chamber substrate side surface 30*a* of the multilayer substrate 30 is a wall surface of the pressure chamber 12 on the multilayer substrate 30 side.

As the material forming the vibration plate 16, a silicon oxide represented by $SiO_x$, a metal oxide, ceramics, a synthetic resin, or the like can be used. The vibration plate may be integrally formed with the pressure chamber substrate by modifying the front surface of the pressure chamber substrate or may be bonded to the pressure chamber substrate and laminated. Although not particularly limited, the vibration plate can be formed on the pressure chamber substrate by thermally oxidizing the silicon wafer for the pressure chamber substrate with a diffusion furnace at approximately 1000° C. to 1200° C. In addition, the vibration plate may have a laminated structure such as a structure in which a zirconium oxide layer is laminated on a silicon oxide layer.

The piezoelectric element 3 illustrated in FIGS. 2 and 3 includes a first electrode 21 formed on the vibration plate 16, a piezoelectric layer 23 formed on the first electrode 21, and a second electrode 22 formed on the piezoelectric layer 23. One of the electrodes 21 and 22 may be a common electrode arranged in a range corresponding to the plurality of pressure chambers 12. In FIG. 1, it is illustrated that the first electrode 21 is coupled, as an individual electrode, to a coupling wiring 66 such as a flexible substrate. As the material forming the electrodes 21 and 22, one or more materials such as platinum represented by Pt, gold represented by Au, iridium represented by Ir, titanium represented by Ti, and conductive oxides of these metals can be used. The thickness of the electrodes 21 and 22 is not particularly limited, and can be set to approximately several nm to several hundred nm. A lead electrode made of a conductive material such as a metal may be coupled to at least one of the electrodes 21 and 22. As the piezoelectric layer 23, a ferroelectric material such as a lead-based perovskite oxide such as PZT, a non-lead-based perovskite oxide, or the like can be used. Here, PZT is an abbreviation for lead zirconate titanate, and is $Pb(Zr_x,Ti_{1-x})O_3$) in stoichiometric ratio. The thickness of the piezoelectric layer 23 is not particularly limited, and can be set to approximately several hundred nm to several μm.

The electrodes 21 and 22 and the lead electrode can be formed by, for example, forming and patterning an electrode film on a vibration plate by a vapor phase method such as a sputtering method. The piezoelectric layer 23 can be formed by, for example, baking and patterning a piezoelectric precursor film formed on the first electrode by a liquid phase method such as a spin coating method or a gas phase method.

A driving element for moving the liquid from the pressure chamber to the nozzle is not limited to the above-described piezoelectric element 3, and a heating element or the like for generating a bubble in the pressure chamber by heat generation may be used. Therefore, the actuator 2 is not limited to the piezoelectric actuator including the piezoelectric element and the vibration plate, and may be an actuator including a heating element that transmits heat to the pressure chamber.

The multilayer substrate 30 illustrated in FIGS. 1 to 3 has a liquid flow path including the common liquid chamber 40, an inflow flow path 38 coupled to the common liquid chamber 40 from the second common liquid chamber 72 of the case head 70, the supply flow path 32 coupled to the pressure chamber 12 from the common liquid chamber 40, and the communication flow path 31 coupled to the nozzle 81 of the nozzle plate 80 from the pressure chamber 12. Since the multilayer substrate 30 has the above-described liquid flow path, the multilayer substrate 30 is also called a flow path substrate. The pressure chamber substrate 10 and the case head 70 are bonded to the pressure chamber substrate side surface 30*a* of the multilayer substrate 30. The multilayer substrate 30 and the case head 70 are bonded to each other by an adhesive, for example. The nozzle plate 80 and the sealing plate 90 are bonded to a nozzle plate side surface 30*b* of the multilayer substrate 30. The multilayer substrate 30 and the nozzle plate 80 are bonded to each other by an adhesive, for example. The multilayer substrate 30 and the sealing plate 90 are bonded to each other by an adhesive, for example.

As illustrated in FIGS. 2 and 3, the multilayer substrate 30 of the specific example includes the first flow path arrangement layer 131, the insulating layer 141, and the second flow path arrangement layer 132 in order from the nozzle plate 80 side. The multilayer substrate 30 has the common liquid chamber 40 on the side of the first flow path arrangement layer 131 from the position of the insulating layer 141, and includes the liquid chamber wall portion 33 on the side of the second flow path arrangement layer 132 from the position of the insulating layer 141. A liquid chamber wall surface 33*a* facing the common liquid chamber 40 in the liquid chamber wall portion 33 is aligned with the surface of the second flow path arrangement layer 132 on the side of the insulating layer 141. The sealing plate 90 is a portion of the wall of the common liquid chamber 40. The multilayer substrate 30 has two common liquid chambers 40 as illustrated in FIG. 1. Each common liquid chamber 40 is arranged on the multilayer substrate 30 corresponding to the pressure chamber row.

The common liquid chamber 40 stores liquid Q1 such as ink. The inflow flow path 38 has a hole shape penetrating the second flow path arrangement layer 132 in the Z direction and allows the liquid Q1 to pass from the second common liquid chamber 72 of the case head 70 to the common liquid chamber 40. An inlet port 42, which is an outlet portion of the inflow flow path 38, is an opening portion of the inflow flow path 38 formed in the common liquid chamber 40. The position of the inflow port 42 is aligned with the surface of the second flow path arrangement layer 132 on the side of the insulating layer 141. The supply flow path 32 has a hole shape penetrating the second flow path arrangement layer 132 in the Z direction, and is an individual flow path arranged for each pressure chamber 12. Therefore, the liquid flow path branches from the common liquid chamber 40 into a plurality of supply flow paths 32. Each supply flow path 32 passes the liquid Q1 from the common liquid chamber 40 to the corresponding pressure chamber 12. A supply port 44 which is an inlet portion of the supply flow path 32 is an opening portion of the supply flow path 32 formed in the common liquid chamber 40, and is coupled to the liquid chamber wall surface 33*a* of the liquid chamber wall portion 33. The plurality of supply ports 44 in each common liquid chamber 40 are arranged in the Y direction in which the pressure chambers 12 are arranged. The position of each of the supply ports 44 is aligned with the surface of the second flow path arrangement layer 132 on the side of the insulating layer 141. The communication flow path 31 has a hole shape that penetrates the entire multilayer substrate 30 in the first direction D1 which is the Z direction, and is an individual flow path arranged for each pressure chamber 12. Therefore, the communication flow path 31 has a hole shape that penetrates the first flow path arrangement layer 131, the insulating layer 141, and the second flow path arrangement layer 132. Each communication flow path 31 passes the liquid Q1 from the pressure chamber 12 to the nozzle 81. The multilayer substrate 30 has two rows of communication flow paths 31 aligned with the pressure chamber rows. In each row of the communication flow path 31, as illustrated in FIG. 3, the communication flow paths 31 may be linearly arranged in the Y direction, or the communication flow paths 31 may be arranged in a zigzag manner. The adjacent communication flow paths 31 are separated by a partition wall 31*a* including the first flow path arrangement layer 131, the insulating layer 141, and the second flow path arrangement layer 132.

As will be described in detail later, the projection portion 300 is disposed at a position in the Z direction in the communication flow path 31. In the specific example, the projection portion 300 is also disposed in the inlet portion coupled to the liquid chamber wall surface 33*a* in the supply flow path 32.

As the materials forming the first flow path arrangement layer 131 and the second flow path arrangement layer 132, semiconductors such as silicon represented by Si, metals, ceramics, and the like can be used. As the material forming the insulating layer 141, silicon oxide, metal oxide, ceramics, synthetic resin, or the like can be used. Although not particularly limited, when an SOI substrate is used for the multilayer substrate 30, the first flow path arrangement layer 131 and the second flow path arrangement layer 132 are made of silicon and the insulating layer 141 is made of silicon oxide. As the SOI substrate, for example, it is possible to use a multilayer substrate in which the first flow path arrangement layer 131 and the second flow path arrangement layer 132 are silicon single crystal substrates and whose surface is the (110) plane.

The liquid flow path of the multilayer substrate 30 can be formed by, for example, anisotropic wet etching using an alkaline solution such as KOH aqueous solution or the like.

As illustrated in FIGS. 1 and 2, the protective substrate 50 of the specific example has a space 52 that does not interfere with the movement of the piezoelectric element 3 in a region facing the piezoelectric element 3, and is bonded onto the pressure chamber substrate 10 including the piezoelectric element 3. The protective substrate 50 and the pressure chamber substrate 10 are bonded to each other with an adhesive, for example. Since the protective substrate 50 covers the actuator 2, the actuator 2 is protected from intrusion of liquid or the like. As a material forming the protective substrate 50, a semiconductor such as silicon, a metal such as stainless steel, ceramics, glass, a synthetic resin, or the like can be used. Although not particularly limited, the protective substrate 50 can be formed of a silicon single crystal substrate having a relatively large film thickness of, for example, approximately several hundred μm and high rigidity.

When the actuator 2 is protected by the case head or the like, it is possible to omit the protective substrate 50 from the liquid ejecting head 1.

As illustrated in FIGS. 1 and 2, the case head 70 of the specific example has the second common liquid chamber that stores liquid Q1 to be supplied to each common liquid chamber 40, and then to the pressure chamber row. The case head 70 has a space forming portion 71 located in a region facing the protective substrate 50, a gap 74 through which the coupling wiring 66 passes, and the like, and is bonded to the pressure chamber substrate side surface 30*a* of the multilayer substrate 30. The case head 70 and the multilayer substrate 30 are bonded to each other with an adhesive, for example. The space forming portion 71 has a space into which the protective substrate 50 is received. The second common liquid chamber 72 stores the liquid Q1 flowing in from a liquid introduction portion 73. The pressure chamber substrate side surface 30*a* of the multilayer substrate 30 is a portion of the wall surface of the pressure chamber 12 and also is a portion of the wall surface of the second common liquid chamber 72. As the material forming the case head 70, glass, ceramics, a metal such as stainless steel, a synthetic resin, a semiconductor such as silicon, or the like can be used.

A drive circuit 65 illustrated in FIG. 1 drives the piezoelectric element 3 via the coupling wiring 66 electrically coupled to the electrodes 21 and 22. For the drive circuit 65, a circuit board, an IC, or the like can be used. Here, IC is an abbreviation for integrated circuits. Although not illustrated, the coupling wiring 66 is coupled to a control device of the liquid ejecting apparatus, and the drive circuit 65 is controlled by the control device via the coupling wiring 66 to drive the piezoelectric element 3. For the coupling wiring 66 including the drive circuit 65, FPC, COF, or the like can be used. Here, FPC is an abbreviation for "flexible printed circuit". COF is an abbreviation for "chip on film".

As illustrated in FIGS. 1 to 3, the nozzle plate 80 of the specific example has a plurality of nozzles 81 penetrating in the Z direction and is bonded to the nozzle plate side surface 30*b* of the multilayer substrate 30. The nozzle plate 80 and the multilayer substrate 30 are bonded to each other with an adhesive, for example. The nozzle 81 is an opening portion formed in the flat plate-like nozzle plate 80 and penetrates in the Z direction. The nozzle plate 80 has two rows of nozzles 81 aligned with the pressure chamber row. In each row of the nozzles 81, as illustrated in FIG. 3, the nozzles 81 may be linearly arranged in the Y direction, or the nozzles 81 may be arranged in a zigzag manner. A surface of the nozzle plate on a side opposite to the surface bonded to the multilayer substrate 30 is a nozzle surface 80*b* from which the liquid droplet Q0 is discharged. A negative pressure is applied to the nozzle surface 80*b* at the time of cleaning.

As the material forming the nozzle plate 80, a metal such as stainless steel, glass, ceramics, synthetic resin, a semiconductor such as silicon, or the like can be used. Although not particularly limited, the nozzle plate 80 can be formed of glass ceramics having a thickness of, for example, approximately 0.01 to 1 mm.

The sealing plate 90 illustrated in FIGS. 1 and 2 is a flexible film and functions as a vibration absorbing body that absorbs pressure fluctuations of the liquid Q1 in the common liquid chamber 40. Since the sealing plate 90 has a compliance function, the sealing plate 90 is also called a compliance sheet. The sealing plate 90 sealing each common liquid chamber 40 is bonded to the nozzle plate side surface 30*b* of the multilayer substrate 30 as a portion of the wall of the common liquid chamber 40. The sealing plate 90 and the multilayer substrate 30 are bonded to each other with an adhesive, for example. In addition to sealing the common liquid chamber 40 with the sealing plate 90 for each common liquid chamber 40, a plurality of common liquid chambers 40 may be collectively sealed with one sealing plate to seal the common liquid chamber 40. In addition, instead of the sealing plate 90, the common liquid chamber 40 may be sealed by the nozzle plate 80. As a material forming the common liquid chamber 40, a synthetic resin, a semiconductor such as silicon, a metal such as stainless steel, or the like can be used.

In the liquid ejecting head 1 having the above-described structure, the liquid Q1 sequentially passes through the liquid introduction portion 73, the second common liquid chamber 72, the inflow flow path 38, the common liquid chamber 40, the supply flow path 32, the pressure chamber 12, and the communication flow path 31, and is ejected as a droplet Q0 from the nozzle 81 by the operation of the actuator 2. Here, the liquid introduction portion 73, the second common liquid chamber 72, the inflow flow path 38, and the common liquid chamber 40 are common flow paths for the plurality of pressure chambers 12. The supply flow path 32, the pressure chamber 12, the communication flow path 31, and the nozzle 81 are individual flow paths corresponding to each pressure chambers 12. Therefore, the liquid Q1 in the common liquid chamber 40 is divided into individual supply flow paths 32 and flows out. When the drive circuit 65 applies a voltage between the first electrode 21 and the second electrode 22 to bend the actuator 2 toward the pressure chamber 12 side, the liquid Q1 in the pressure chamber 12 flows to the nozzle 81 via the communication flow path 31. As a result, the liquid droplet Q0 is ejected from the nozzle 81. In addition, when the drive circuit 65 stops applying the above-described voltage, the actuator 2 moves to the side opposite to the pressure chamber 12, and thus the liquid Q1 in the common liquid chamber 40 flows into the pressure chamber 12 via the supply flow path 32. Therefore, the actuator 2 can repeatedly eject the liquid droplet Q0 from the nozzle 81.

When a plurality of droplets Q0 ejected by the liquid ejecting head 1 land on a print substrate, dots of the plurality of droplets Q0 are formed on the print substrate, and a printing image of a plurality of dots is expressed on the print substrate. Here, the print substrate is a material that holds a printed image, and has various two-dimensional shapes such as a polygon and a circle, and various three-dimensional shapes such as prismatic and spherical. As the material forming the print substrate, paper, synthetic resin, metal, ceramics, and the like can be used. Dots are the smallest unit of recording results formed by the liquid droplets on the print substrate. In order to increase the resolution of the printed image, it is necessary to make the nozzle pitch finer, for example, 300 dpi or more. In order to make the nozzle pitch finer, it is necessary to narrow the interval between the adjacent nozzles 81, and it is necessary to thin the partition wall 31*a* partitioning the adjacent communication flow paths 31. However, when the partition wall 31*a* is thin, the partition wall 31*a* is likely to be bent by the internal pressure of the liquid Q1 when ejecting the liquid droplet Q0 and the crosstalk phenomenon is likely to occur in which whether or not the liquid droplets are ejected from the adjacent nozzles affects the ejection of the liquid droplets. When the crosstalk phenomenon occurs, the landing position of the liquid droplet Q0 is not stabilized, and the image quality of the printed image is deteriorated.

For example, two nozzles 81 adjacent to each other are defined as a first nozzle and a second nozzle, the communication flow path 31 coupled to the first nozzle is defined as a first communication flow path, and the communication flow path 31 coupled to the second nozzle is defined as a second communication flow path. When the liquid droplet Q0 is ejected from the first nozzle and the liquid droplet Q0 is not ejected from the second nozzle, the internal pressure of the liquid in the first communication flow path is higher than the internal pressure of the liquid in the second communication flow path at the time of ejecting the liquid droplets. In this case, when the rigidity of the partition wall 31*a* is low, the partition wall 31*a* is bent toward the second communication flow path. On the other hand, when the liquid droplet Q0 is also ejected from the second nozzle, and the timing of ejecting the liquid droplet Q0 from the first nozzle and the timing of ejecting the liquid droplet Q0 from the second nozzle are exactly the same as each other, the bending of the partition wall 31*a* is suppressed.

From the above, the crosstalk phenomenon occurs.

In particular, in order to suppress the pressure loss of the liquid Q1 of the common liquid chamber 40, it is necessary to increase the thickness of the substrate having the common liquid chamber 40 to expand the common liquid chamber 40 in the Z direction. In this case, the communication flow path 31 penetrating through the substrate having the common liquid chamber 40 in the Z direction becomes longer, and the rigidity of the partition wall 31*a* is reduced accordingly. Therefore, the problem of crosstalk phenomenon becomes more prominent.

In addition, since silicon is a material which is likely to be bent, when the substrate having the common liquid chamber 40 is a silicon substrate, the partition wall 31*a* is likely to be bent. Therefore, the problem of crosstalk phenomenon becomes more prominent.

In order to suppress the crosstalk phenomenon, it is necessary to increase the rigidity of the partition wall 31*a* between the communication flow paths 31. However, when the bubble remains in the communication flow path 31 due to the structure for increasing the rigidity of the partition wall 31*a*, the bubble affects the ejection of the liquid droplet Q0, so it is necessary to suppress the residual bubbles in the communication flow path 31.

Therefore, in this specific example, by utilizing the insulating layer 141 of the multilayer substrate 30, the inclined portion having the inclined wall surface to the first direction D1 which is the direction of the communication flow path 31 and is the Z direction is formed in the communication flow path 31. Due to the inclined portion in the communication flow path 31, the rigidity of the partition wall 31*a* between the communication flow paths 31 is increased, the flow of the liquid Q1 improves, and the residual bubbles in the communication flow path 31 are suppressed.

(3) DESCRIPTION OF COMMUNICATION FLOW PATH ACCORDING TO SPECIFIC EXAMPLE

Figure 4:
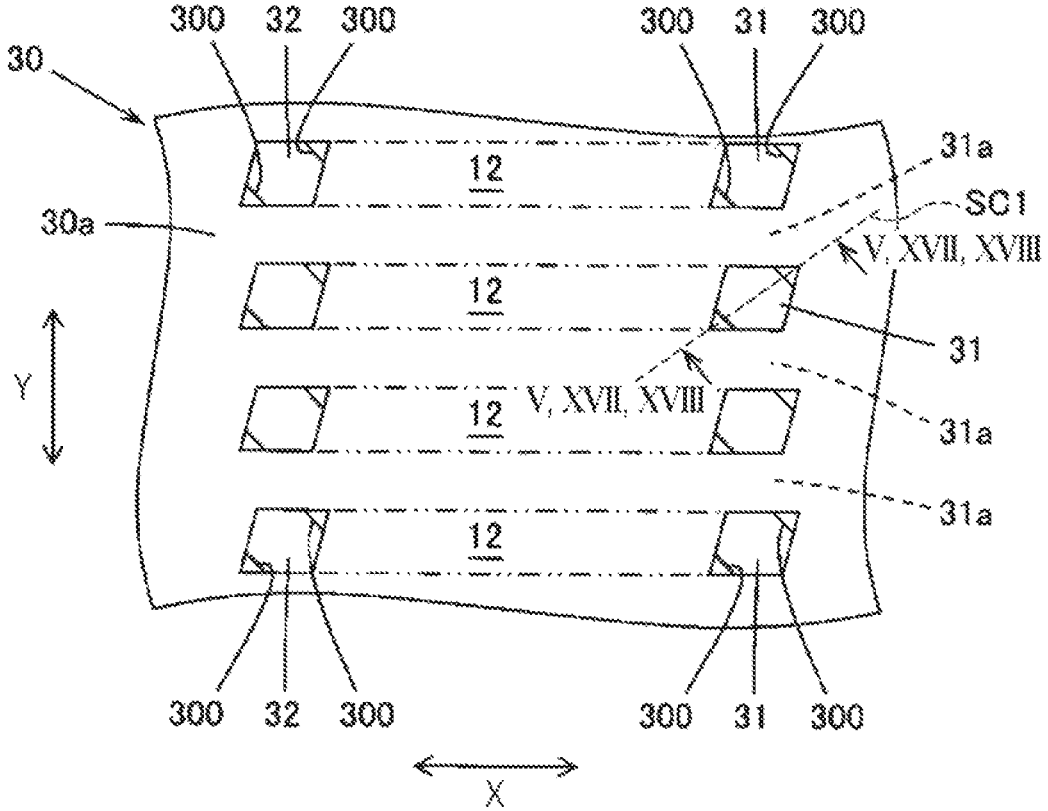
FIG. 4 is a plan view schematically illustrating an example of a multilayer substrate as viewed from a pressure chamber substrate.

FIG. 4 schematically illustrates the multilayer substrate 30 as viewed from the pressure chamber substrate 10. In FIG. 4, the positions of the pressure chambers 12 are indicated by two-dot chain lines. FIG. 5 schematically illustrates the first cross section SC1 of the multilayer substrate 30 at a position of V-V in FIG. 4. FIG. 6A schematically illustrates the second cross section SC2 of the communication flow path 31 at a position of VIA-VIA in FIG. 5. FIG. 6B schematically illustrates a fourth cross section SC4 of the communication flow path 31 at a position of VIB-VIB in FIG. 5. FIG. 6C schematically illustrates an example of a third cross section SC3 of the communication flow path 31 at a position of VIC-VIC in FIG. 5.

Here, reference numeral D2 is a second direction that intersects with the first direction D1. The second direction D2 of the specific example is a direction included in the direction along the multilayer substrate 30, a direction passing through two projection portions 300 which face each other in a plan view as illustrated in FIG. 4, and is orthogonal to the first direction D1. The first cross section SC1 is a longitudinal cross section along the first direction D1 and the second direction D2. The second cross section SC2, the third cross section SC3, and the fourth cross section SC4 are cross sections orthogonal to the first direction D1.

In a plan view illustrated in FIG. 4, the shape of each communication flow path 31 and each supply flow path 32 is substantially parallelogram. In each of the communication flow paths 31 and the supply flow paths 32, two projection portions 300 facing each other are formed. In the specific example, the two projection portions 300 arranged in the communication flow paths 31 will be described in detail.

As illustrated in FIG. 5, in the first cross section SC1, the communication flow path 31 includes the first portion 310 having the first width W1, the second portion 320 having the second width W2, and the third portion 330 having the second width W2 in a direction D3 opposite to the second portion 320 from the first portion 310. The first portion 310 includes the insulating layer 141. In the example illustrated in FIG. 5, although the second portion 320 is disposed in the second flow path arrangement layer 132, and the third portion 330 is disposed in the first flow path arrangement layer 131, the second portion 320 may be disposed in the first flow path arrangement layer 131, and the third portion 330 may be disposed in the second flow path arrangement layer 132.

The first width W1 of the first portion 310 is narrower than the second width W2 of the second portion 320 and the third portion 330. Therefore, the first portion 310 including the insulating layer 141 protrudes inside the communication flow path 31 from the second portion 320 and the third portion 330. The widths of the second portion 320 and the third portion 330 are not limited to the second width W2, and may be different from each other.

In addition, the communication flow path 31 includes the first inclined portion 340 having the first wall surface 341 inclined to the first direction D1 between the first portion 310 and the second portion 320. The first inclined portion 340 has an inclination inside the communication flow path 31 as the first inclined portion 340 approaches the first portion 310. In this specific example, the pressure chamber substrate side surface 30*a*, which is the front surface of the second flow path arrangement layer 132 made of silicon single crystal, is a (110) plane and the first wall surface 341 is a (111) plane. The first inclined portion 340 is separated from the first coupling portion J1 between the communication flow path 31 and the pressure chamber 12 and the second portion 320 is provided between the first inclined portion 340 and the first coupling portion J1. A range 345 from the first portion 310 to the first inclined portion 340 in the communication flow path 31 includes the intermediate position 346 in the first direction D1 in the communication flow path 31. Therefore, the first inclined portion 340 is separated from the second coupling portion J2 between the communication flow path 31 and the nozzle 81. In the example illustrated in FIG. 5, the range of the first portion 310 includes the intermediate position 346 in the communication flow path 31. As matter of course, the range of the first inclined portion 340 may include the intermediate position 346 in the communication flow path 31.

The communication flow path 31 includes the second inclined portion 350 having a second wall surface 351 inclined to the first direction D1 between the first portion 310 and the third portion 330. The second inclined portion 350 has an inclination inside the communication flow path 31 as the second inclined portion 350 approaches the first portion 310. In this specific example, the nozzle plate side surface 30*b*, which is the front surface of the first flow path arrangement layer 131 made of silicon single crystal, is a (110) plane and the second wall surface 351 is a (111) plane. The second inclined portion 350 is separated from the second coupling portion J2 between the communication flow path 31 and the nozzle 81, and the third portion 330 is provided between the second inclined portion 350 and the second coupling portion J2. Although not illustrated in FIG. 5, a range from the first portion 310 to the second inclined portion 350 in the communication flow path 31 includes the intermediate position 346 in the first direction D1 in the communication flow path 31. Therefore, the second inclined portion 350 is separated from the first coupling portion J1 of the communication flow path 31 and the pressure chamber 12. The range of the second inclined portion 350 may include the intermediate position 346 in the communication flow path 31.

As described above, the first inclined portion 340, the first portion 310, and the second inclined portion 350 constitute the projection portion 300 protruded inside the communication flow path 31 from the second portion 320 and the third portion 330. As described above, the range of the projection portion 300 in the first direction D1 in the communication flow path 31 includes the intermediate position 346 in the first direction D1 in the communication flow path 31.

As illustrated in FIG. 6A, the second cross section SC2 of the second portion 320 of the communication flow path is a substantially parallelogram. The shape of the second portion 320 in the second cross section SC2 has the first angle AN1 and the second angle AN2 facing the first angle AN1. The first angle AN1 and the second angle AN2 constitute a diagonal in the parallelogram. When θ is the internal angle of the first angle AN1 and the second angle AN2, $0°<\theta<90°$, and preferably $45°<\theta<90°$. Therefore, the first angle AN1 and the second angle AN2 are acute angles.

As illustrated in FIG. 6C, the third cross section SC3 of the third portion 330 of the communication flow path 31 is a substantially parallelogram. The shape of the third portion 330 in the third cross section SC3 has the third angle AN3 and the fourth angle AN4 facing the third angle AN3. The third angle AN3 and the fourth angle AN4 constitute a diagonal in the parallelogram. When θ is the internal angle of the third angle AN3 and the fourth angle AN4, $0°<\theta<90°$, and preferably $45°<\theta<90°$. Therefore, the third angle AN3 and the fourth angle AN4 are acute angles. The third angle AN3 is disposed in the first direction D1 from the first angle AN1 illustrated in FIG. 6A. The fourth angle AN4 is disposed in the first direction D1 from the second angle AN2 illustrated in FIG. 6A.

As illustrated in FIG. 5, the projection portion 300 including the first inclined portion 340, the first portion 310, and the second inclined portion 350 has two portions in the communication flow path 31, and is disposed between the first angle AN1 and the third angle AN3 and between the second angle AN2 and the fourth angle AN4. Therefore, as illustrated in FIG. 6B, the fourth cross section SC4 of the first portion 310 of the communication flow path 31 has a substantially hexagonal shape such that the diagonal of an acute angle is cut off from the parallelogram.

As illustrated in FIG. 5, since the protrusion 300 protrudes inside the communication flow path 31 from the second portion 320 and the third portion 330 in the first cross section SC1 along the first direction D1 and the second direction D2, the rigidity of the partition wall 31*a* of the communication flow path 31 is increased. Since the projection portion 300 is separated from the first coupling portion J1 between the communication flow path 31 and the pressure chamber 12 and is separated from the second coupling portion J2 between the communication flow path 31 and the nozzle 81, the projection portion 300 is disposed in a portion of the partition wall 31*a* which is likely to be bent. As a result, the rigidity of the partition wall 31*a* is effectively increased. In particular, since the range of the projection portion 300 in the first direction D1 in the communication flow path 31 includes the intermediate position 346 in the first direction D1 in the communication flow path 31, the projection portion 300 is disposed at a particularly easily bendable portion of the partition wall 31*a*. As a result, the rigidity of the partition wall 31*a* is more effectively increased. When the rigidity of the partition wall 31*a* increases, the crosstalk phenomenon is suppressed, the landing position of the liquid droplet Q0 is more stabilized, and the image quality of the printed image is improved.

When the bubble remains in the communication flow path 31 as described above, the bubble affects the ejection of the liquid droplet Q0, and therefore a treatment of removing the bubble from the liquid flow path is performed by a cleaning device (not illustrated). The cleaning device has a cap that covers the nozzle surface 80*b*, sucks air in the cap, and applies a negative pressure of, for example, approximately −20 kPa to −60 kPa to the nozzle surface 80*b* to forcibly suck the liquid Q1 from the nozzle 81. As a result, the flow of the liquid Q1 in the first direction D1 occurs in the communication flow path 31.

In this specific example, since there is the first inclined portion 340 that gradually narrows from the second portion 320 toward the first portion 310 having a narrower width in the communication flow path 31, when the liquid Q1 flows through the communication flow path 31 in the first direction D1 at the time of cleaning or the like, the flow improves, and the bubble is guided by the first inclined portion 340 and easily gets over the first portion 310. Therefore, the residual bubbles in the communication flow path 31 are suppressed.

Furthermore, since there is the second inclined portion 350 which gradually expands from the first portion 310 having a narrow width toward the third portion 330, when the liquid Q1 flows in the first direction D1 at the time of cleaning or the like, the liquid Q1 is unlikely to stagnate between the first portion 310 and the third portion 330. In particular, the first angle AN1, the second angle AN2, the third angle AN3, and the fourth angle AN4 are acute angles, the flow of the liquid Q1 is likely to be delayed in the vicinity of these angles AN1, AN2, AN3, and AN4. Since the second inclined portion 350 is disposed between the first angle AN1 and the third angle AN3, and between the second angle AN2 and the fourth angle AN4, the stagnation of the liquid Q1 is effectively suppressed, the flow of the liquid Q1 improves, and the bubble is likely to flow out. Therefore, the residual bubbles in the communication flow path 31 are suppressed.

In addition, as illustrated in FIG. 6B, the fourth section SC4 of the first portion 310 has a substantially hexagonal shape and is close to a circular shape as compared with a substantially parallelogram shape. When the cross section passing through the projection portion in the communication flow path is substantially parallelogram and the bubbles adhere to the projection portion, the liquid flows through the acute angle portion of the substantially parallelogram which is the side of the bubbles at the time of cleaning, and therefore there is a possibility that the bubbles are unlikely to be discharged. When the fourth cross section SC4 of the first portion 310 is substantially hexagonal as in this specific example, the flow of the liquid is suppressed, and thus the bubbles are easily discharged from the first portion 310 at the time of cleaning.

As described above, in this specific example, it is possible to improve the discharge performance of the bubbles in the communication flow path while increasing the rigidity of the wall of the communication flow path. When the plurality of nozzles are arranged on the nozzle plate, it is possible to improve the discharge performance of the bubbles in the communication flow path while suppressing the crosstalk phenomenon.

(4) SPECIFIC EXAMPLE OF MANUFACTURING METHOD OF LIQUID EJECTING HEAD

Next, with reference to FIGS. 7A to 7C, 8A to 8C, 9A to 9C, 10A and 10B, and the like, a manufacturing method of the liquid ejecting head 1 will be exemplified. FIGS. 7A to 7C, 8A to 8C, 9A to 9C, 10A and 10B schematically illustrate a forming method of the multilayer substrate 30 having the liquid flow path. For the sake of convenience, a cross section of the substrate is illustrated at a position passing through the projection portion 300 in a positional relationship in which the multilayer substrate 30 illustrated in FIG. 2 is turned upside down. For the sake of clarity, elements appearing behind are omitted, and the ratio of the thickness of each layer may be different from the actual ratio.

Figure 7A:
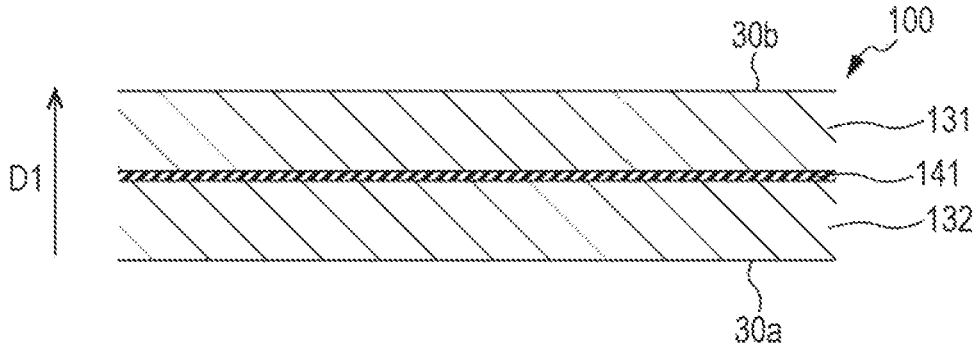
FIGS. 7A to 7C are cross-sectional views schematically illustrating an example of a manufacturing step of the liquid ejecting head.

FIG. 7A illustrates a cross section of a base substrate 100 for forming the multilayer substrate 30 having the liquid flow path. The base substrate 100 illustrated in FIG. 7A is an SOI substrate, the first flow path arrangement layer 131 and the second flow path arrangement layer 132 are made of silicon, and the insulating layer 141 is made of silicon oxide. The nozzle plate side surface 30*b* which is the front surface of the first flow path arrangement layer 131 is a (110) plane, and the pressure chamber substrate side surface 30*a* which is the front surface of the second flow path arrangement layer 132 is also a (110) plane. Thicknesses of the first flow path arrangement layer 131 and the second flow path arrangement layer 132 are not particularly limited, and can be set to approximately 100 to 400 μm. The thickness of the insulating layer 141 is not particularly limited, and can be set to approximately 0.4 to 2 μm.

Figure 7B:
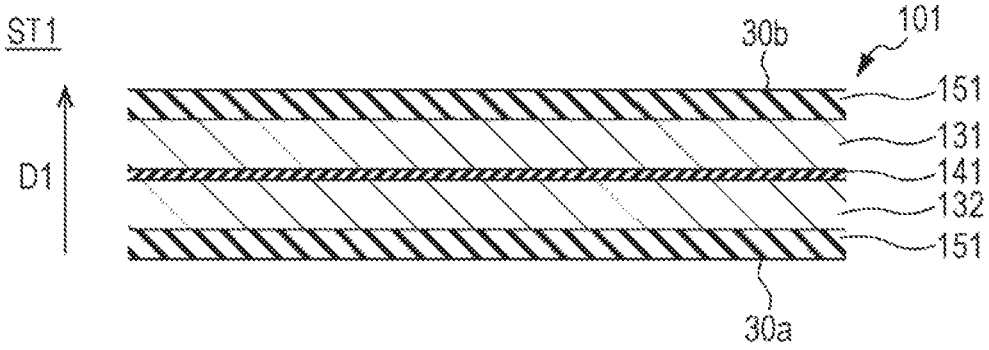

First, in a hard mask forming step ST1, a treatment is performed of forming a hard mask film 151 on the entire surface of the pressure chamber substrate side surface 30*a* and the nozzle plate side surface 30*b*, which are the front surfaces of the base substrate 100. FIG. 7B illustrates a state where the hard mask film 151 is formed on the substrate 101 being processed. The thickness of the hard mask film 151 is not particularly limited, and can be set to approximately 50 nm to 2 μm. As the material forming the hard mask film 151, silicon oxide, silicon nitride, metal oxide, ceramics, synthetic resin, or the like can be adopted. Silicon nitride is expressed as $Si_3N_4$ in stoichiometric ratio. Although not particularly limited, when the base substrate 100 is an SOI substrate, and the base substrate 100 is thermally oxidized in a diffusion furnace at approximately 1000° C. to 1200° C., the hard mask film 151 made of silicon oxide can be integrally formed on the front surface of the base substrate 100. In addition, when the hard mask film 151 is formed of silicon nitride, the hard mask film 151 can be formed by reactive sputtering or the like.

Figure 7C:
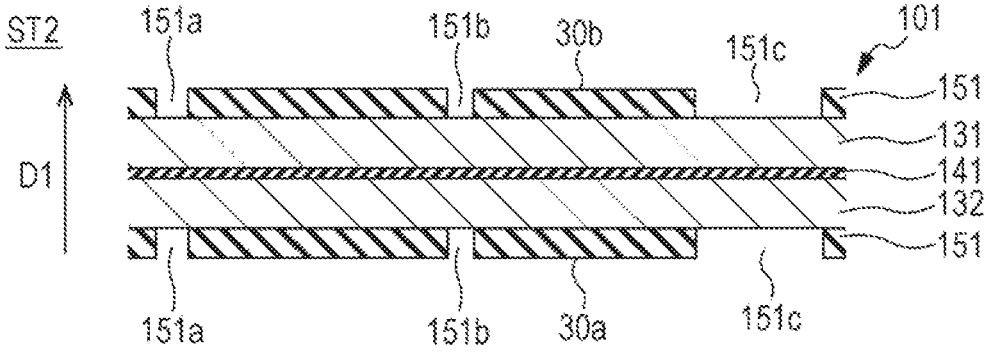

Next, in a first patterning step ST2, as illustrated in FIG. 7C, a treatment is performed of removing the hard mask films in the communication flow path corresponding region 151*a* corresponding to the communication flow path 31, a supply flow path corresponding region 151*b* corresponding to the supply flow path 32, and an inflow flow path corresponding region 151*c* corresponding to the inflow flow path 38 in the hard mask film 151. The first patterning step ST2 may include a first photoresist forming step, a first photoresist patterning step, a first hard mask removing step, and a first photoresist removing step. In the first photoresist forming step, a treatment is performed of applying a photoresist on the hard mask film 151. In the first photoresist patterning step, a treatment is performed of removing photoresist in the communication flow path corresponding region 151*a*, the supply flow path corresponding region 151*b*, and the inflow flow path corresponding region 151*c* of the photoresist by exposure or the like. In the first hard mask removing step, a treatment is performed of removing the portion of the hard mask film 151 not covered with the photoresist by wet etching, using an etchant for removing a portion of the hard mask film 151. As an etchant for this treatment, an aqueous hydrogen fluoride solution, a mixed solution of hydrogen fluoride and ammonium fluoride, or the like can be used. In the first photoresist removing step, a treatment is performed of removing the first photoresist remaining on the hard mask film 151 with a solvent or the like.

Figure 8A:
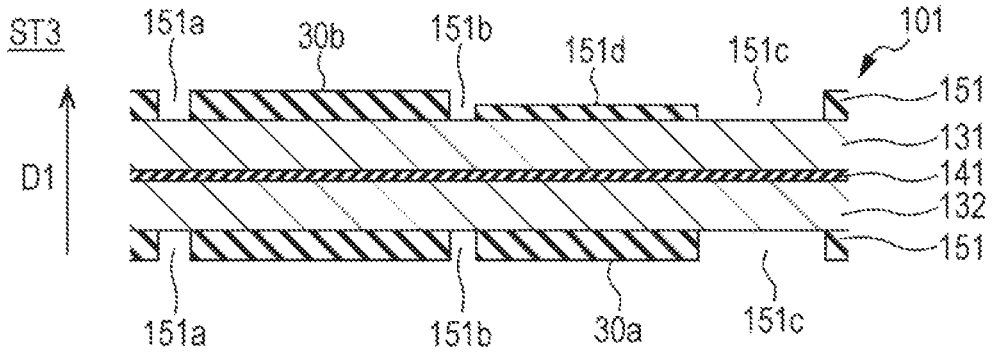
FIGS. 8A to 8C are cross-sectional views schematically illustrating an example of the manufacturing step of the liquid ejecting head.

Next, in the second patterning step ST3, as illustrated in FIG. 8A, a treatment is performed of thinning the hard mask film in the common liquid chamber corresponding region 151*d* corresponding to the common liquid chamber 40 in the hard mask film 151. The second patterning step ST3 may include a second photoresist forming step, a second photoresist patterning step, a second hard mask removing step, and a second photoresist removing step. In the second photoresist forming step, a treatment is performed of applying photoresist on both surfaces of the substrate 101 being processed. In the second photoresist patterning step, a treatment is performed of removing the photoresist in the common liquid chamber corresponding region 151*d* of the photoresist by exposure or the like. In the second hard mask removing step, a treatment is performed of thinning the hard mask film 151 in a portion not covered with the photoresist by wet etching, using an etchant for removing a portion of the hard mask film 151. The thickness of the hard mask film 151 to be left can be decreased by lengthening the wet etching time, and the thickness can be increased by shortening the wet etching time. For the etchant of this treatment, an aqueous solution of hydrogen fluoride, a mixed solution of hydrogen fluoride and ammonium fluoride, or the like can be used. In the second photoresist removal step, a treatment is performed of removing the second photoresist remaining on both surfaces of the substrate 101 being processed with a solvent or the like.

Figure 8B:
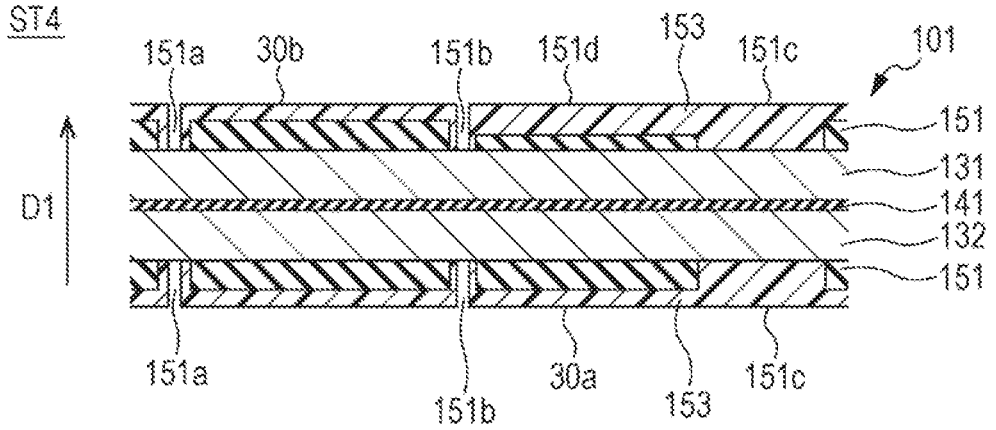
Figure 8C:
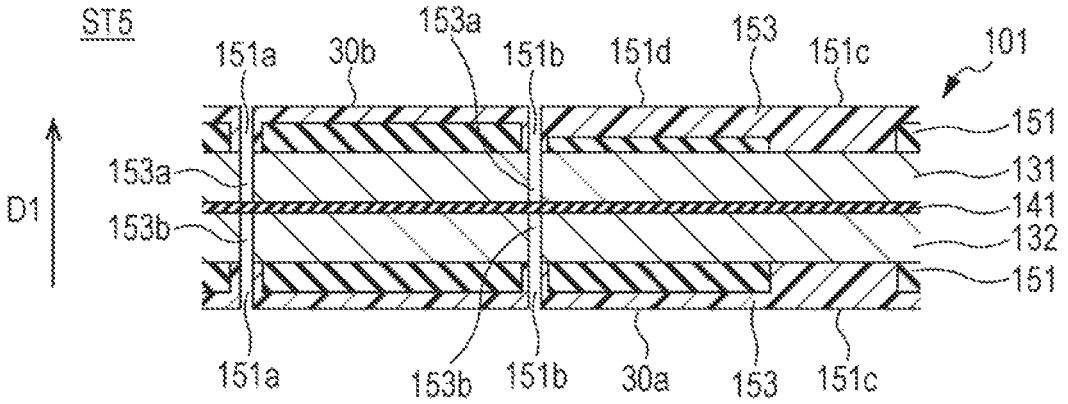

Next, in an ICP mask forming step ST4, as illustrated in FIG. 8B, a treatment is performed of disposing a third photoresist 153 on a portion of the pressure chamber substrate side surface 30*a* and the nozzle plate side surface 30*b* which are the front surfaces of the substrate 101 being processed, except for a plurality of prepared holes. Here, ICP is an abbreviation for inductively coupled plasma. As illustrated in FIG. 8C, the plurality of prepared holes include a plurality of first prepared holes 153*a* on the side of the nozzle plate side surface 30*b* and a plurality of second prepared holes 153*b* on the side of the pressure chamber substrate side surface 30*a*. The plurality of first prepared holes 153*a* are arranged in the communication flow path corresponding region 151*a* and the supply flow path corresponding region 151*b*. The plurality of second prepared holes 153*b* are also arranged in the communication flow path corresponding region 151*a* and the supply flow path corresponding region 151*b*.

The ICP mask forming step ST4 may include a third photoresist forming step and a third photoresist patterning step. In the third photoresist forming step, a treatment is performed of applying photoresist on both surfaces of the substrate 101 being processed. In the third photoresist patterning step, a treatment is performed of removing the third photoresist in regions corresponding to the first prepared hole 153*a* and the second prepared hole 153*b* in the photoresist by exposure or the like.

Next, in a prepared hole formation step ST5, as illustrated in FIG. 8C, a treatment is performed of forming the first prepared hole 153*a* and the second prepared hole 153*b* reaching the insulating layer 141 from both surfaces of the substrate 101 being processed. The first prepared hole 153*a* and the second prepared hole 153*b* in the communication flow path corresponding region 151*a* are thinner than these of the communication flow path 31. The first prepared hole 153*a* and the second prepared hole 153*b* in the supply flow path corresponding region 151*b* are thinner than these of the supply flow path 32.

For forming the first prepared hole 153*a* and the second prepared hole 153*b*, ICP, laser, or the like can be used. In an etching apparatus using ICP, a material to be etched is processed by etching using plasma. When the material to be etched is silicon, gases such as tetrafluoromethane represented by the molecular formula $CF_4$, trifluoromethane represented by the molecular formula $CHF_3$, and the like can be used as the etchant. Although not particularly limited, when forming the first prepared hole 153*a*, and ICP treatment is performed on the side of the nozzle plate side surface 30*b*, it is possible to form, in the first flow path arrangement layer 131, the first prepared holes 153*a* reaching the insulating layer 141. When forming the second prepared hole 153*b*, and ICP treatment is performed on the side of the pressure chamber substrate side surface 30*a*, it is possible to form, in the second flow path arrangement layer 132, the second prepared hole 153*b* reaching the insulating layer 141. In the treatment of ICP, the insulating layer 141 remains without being etched. For forming the first prepared hole 153*a* and the second prepared hole 153*b*, a laser may be used in combination with ICP.

When performing anisotropic wet etching on silicon crystals, the etching rate of the (111) plane is lower than that of the (110) plane and the (100) plane, and etching is difficult. The front surface of the side wall in the first prepared hole 153*a* and the front surface of the side wall in the second prepared hole 153*b* are aligned with the (111) plane along the first direction D1. When anisotropic wet etching is performed on the first flow path arrangement layer 131 and the second flow path arrangement layer 132 in a later step, in a direction orthogonal to the first direction D1, the side walls of the first prepared hole 153*a* and the second prepared hole 153*b* are only etched slowly after expanding in accordance with the position of the hard mask film 151. In addition, since the insulating layer 141 remains in the above-described anisotropic wet etching, a (111) plane inclined to the first direction D1 appears in a portion of the hole wall in the vicinity of the insulating layer 141. Therefore, the first prepared hole 153*a* and the second prepared hole 153*b* are formed in the substrate 101 being processed, and thus the projection portion 300 having the inclined surface of the (111) plane with respect to the communication flow path 31 and the supply flow path 32 is formed more reliably in a later step.

Figure 9A:
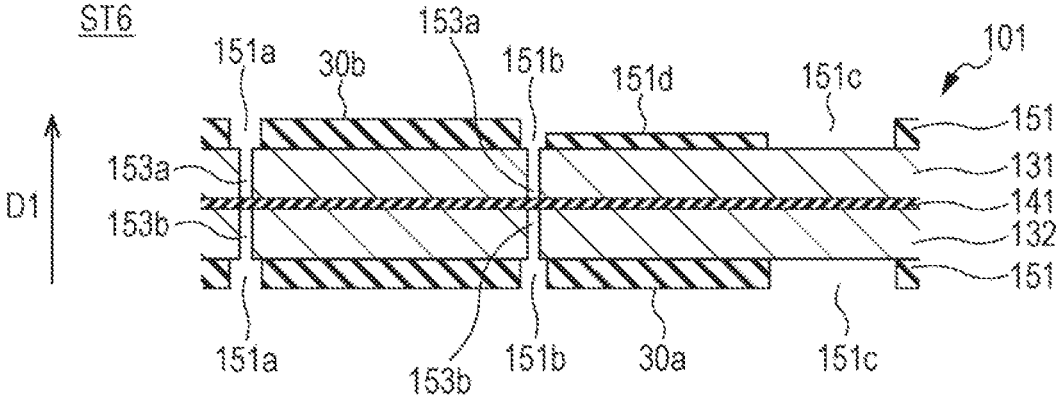
FIGS. 9A to 9C are cross-sectional views schematically illustrating an example of the manufacturing step of the liquid ejecting head.

Next, in an ICP mask removal step ST6, as illustrated in FIG. 9A, a treatment is performed of removing the third photoresist 153 remaining on both surfaces of the substrate 101 being processed with a solvent or the like.

Figure 9B:
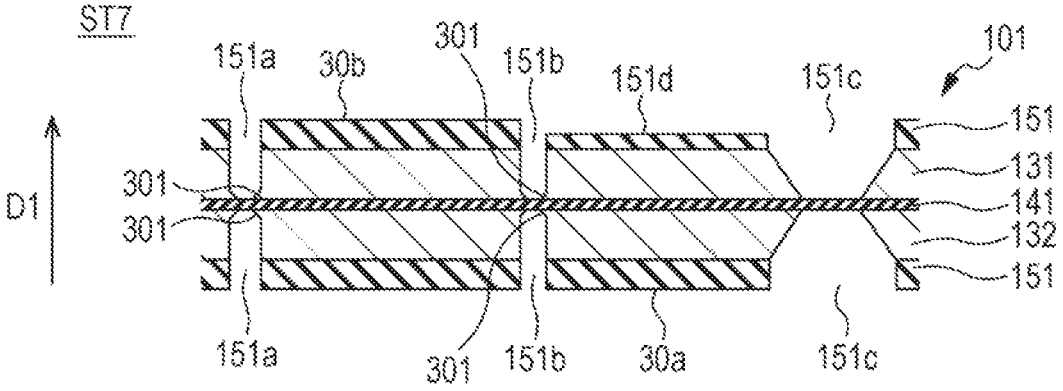

Next, in a first liquid flow path forming step ST7, as illustrated in FIG. 9B, a treatment is performed of removing the portions of the first flow path arrangement layer 131 and the second flow path arrangement layer 132 not covered with the hard mask film 151 by anisotropic wet etching, using an etchant for removing a portion of the first flow path arrangement layer 131 and the second flow path arrangement layer 132. As an etchant for this treatment, an aqueous alkaline solution such as KOH aqueous solution or TMAH aqueous solution can be used. Here, KOH is potassium hydroxide. TMAH is an abbreviation for tetramethylammonium hydroxide. By the anisotropic wet etching, the first prepared hole 153*a* and the second prepared hole 153*b* become thick in the communication flow path corresponding region 151*a*, and the first prepared hole 153*a* and the second prepared hole 153*b* also become thick in the supply flow path corresponding region 151*b*. At this time, in the vicinity of the insulating layer 141, the inclined surface 301 whose wall surface is the (111) plane is formed. In addition, in the inflow flow path corresponding region 151*c*, a recess reaching the insulating layer 141 is formed in the first flow path arrangement layer 131, and a recess reaching the insulating layer 141 is formed in the second flow path arrangement layer 132.

Figure 11:
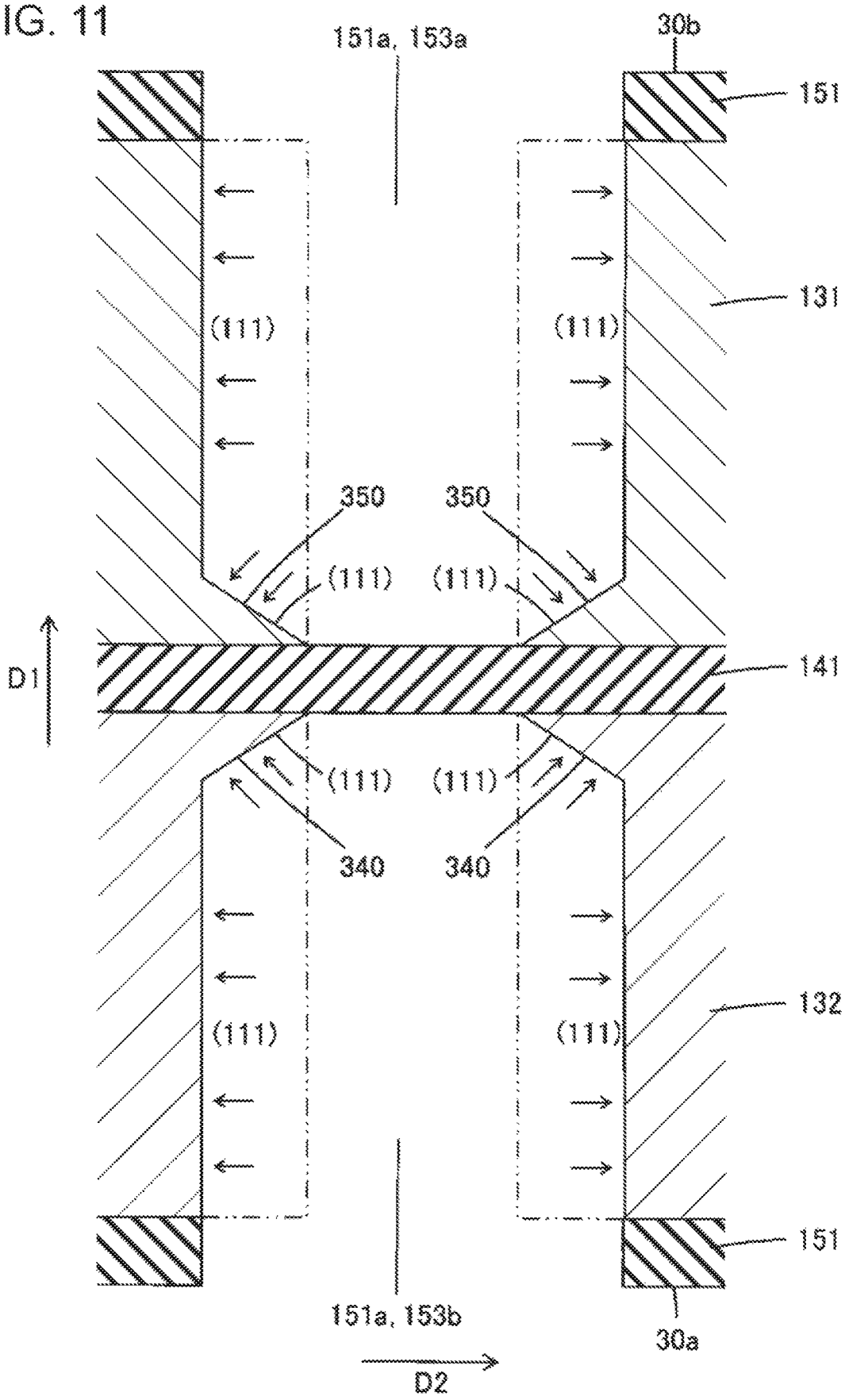
FIG. 11 is a cross-sectional view schematically illustrating an example in which a first flow path arrangement layer and a second flow path arrangement layer in a communication flow path corresponding region are etched.

FIG. 11 schematically illustrates an example in which the first flow path arrangement layer 131 and the second flow path arrangement layer 132 in the communication flow path corresponding region 151*a* are etched in the first cross section SC1 along the first direction D1 and the second direction D2. For the sake of clarity, hatching between the first flow path arrangement layer 131 and the second flow path arrangement layer 132 is omitted. In FIG. 11, positions of the first prepared hole 153*a* and the second prepared hole 153*b* are illustrated by two-dot chain lines.

Since the surfaces of the first flow path arrangement layer 131 and the second flow path arrangement layer 132 are (110) planes, portions which are not covered with the hard mask film 151 are etched relatively quickly. In FIG. 11, the states where the first prepared hole 153*a* and the second prepared hole 153*b* expands are indicated by arrows.

In the hole expanding from the first prepared hole 153*a* and the second prepared hole 153*b*, the front surface of the side wall is along the first direction D1 and is a (111) plane which is hard to etch. In addition, since the insulating layer 141 remains in the anisotropic wet etching, a (111) plane inclined to the first direction D1 appears in a portion of the hole wall in the vicinity of the insulating layer 141. The inclined (111) plane appearing in the second flow path arrangement layer 132 is the first wall surface 341 of the first inclined portion 340 illustrated in FIG. 5. The inclined (111) surface appearing in the first flow path arrangement layer 131 is the second wall surface 351 of the second inclined portion 350 illustrated in FIG. 5.

Figure 9C:
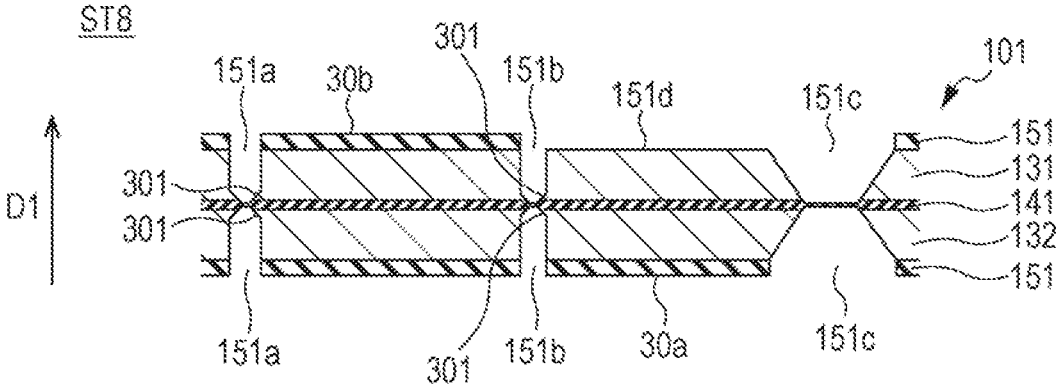

Next, in a third hard mask removing step ST8, as illustrated in FIG. 9C, a treatment is performed of removing a portion of the hard mask film 151 by wet etching using an etchant for removing a portion of the hard mask film 151. For the etchant of this treatment, an aqueous solution of hydrogen fluoride, a mixed solution of hydrogen fluoride and ammonium fluoride, or the like can be used. Here, the portion of the hard mask film 151 in the common liquid chamber corresponding region 151*d* is removed by etching. As a result, the first flow path arrangement layer in the portion of the first flow path arrangement layer 131 in the common liquid chamber corresponding region 151*d* is exposed. The portion of the hard mask film 151 other than the common liquid chamber corresponding region 151*d* is thinned by etching. The insulating layer 141 exposed in the communication flow path corresponding region 151*a*, the supply flow path corresponding region 151*b*, and the inflow flow path corresponding region 151*c* is thinned or removed by etching.

Figure 10A:
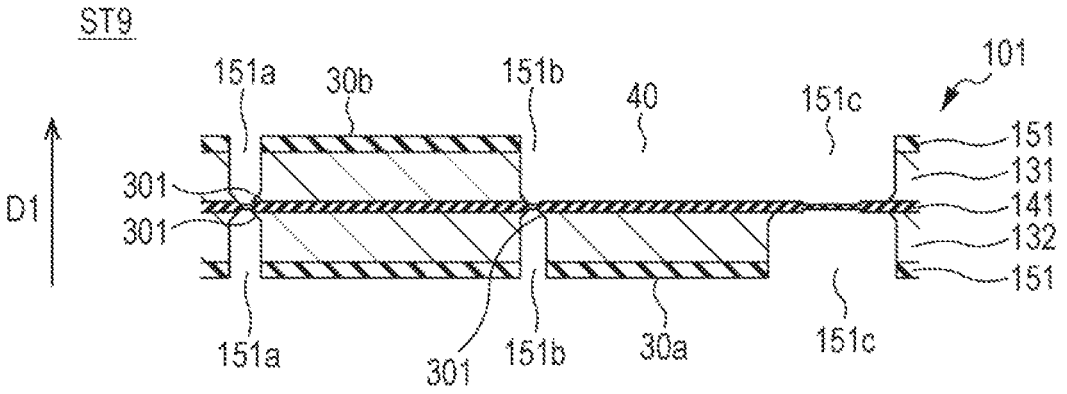
FIGS. 10A and 10B are cross-sectional views schematically illustrating an example of the manufacturing step of the liquid ejecting head.

Next, in a second liquid flow path forming step ST9, as illustrated in FIG. 10A, a treatment is performed of removing the portions of the first flow path arrangement layer 131 and the second flow path arrangement layer 132 not covered with the hard mask film 151 by anisotropic wet etching, using an etchant for removing a portion of the first flow path arrangement layer 131 and the second flow path arrangement layer 132. As an etchant for this treatment, an aqueous alkaline solution such as KOH aqueous solution or TMAH aqueous solution can be used. By the anisotropic wet etching, the first flow path arrangement layer of the first flow path arrangement layer 131 in the common liquid chamber corresponding region 151*d* is removed until the first flow path arrangement layer reaches the insulating layer 141.

Regarding the hole formed in the communication flow path corresponding region 151*a* illustrated in FIG. 11, the (111) plane along the first direction D1 and the (111) plane inclined to the first direction D1 are already appeared. Since the etching rate of (111) is slow, the hole is somewhat expanded.

Figure 10B:
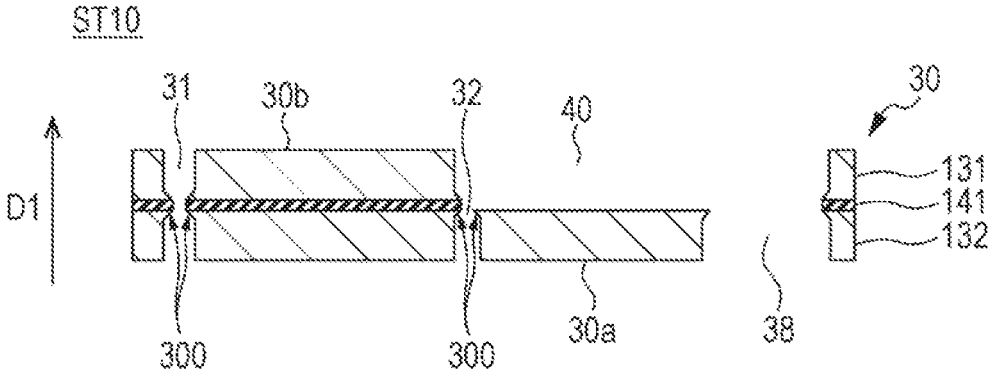

Next, in a fourth hard mask removing step ST10, as illustrated in FIG. 10B, a treatment of removing the hard mask film 151 by wet etching is performed using an etchant for removing the hard mask film 151. For the etchant of this treatment, an aqueous solution of hydrogen fluoride, a mixed solution of hydrogen fluoride and ammonium fluoride, or the like can be used. Here, the insulating layer 141 exposed in the communication flow path corresponding region 151*a*, the supply flow path corresponding region 151*b*, and the inflow flow path corresponding region 151*c* is removed by etching. As a result, the communication flow path 31 is formed in the communication flow path corresponding region 151*a*, the supply flow path 32 is formed in the supply flow path corresponding region 151*b*, and the inflow flow path 38 is formed in the inflow flow path corresponding region 151*c*. That is, by performing the fourth hard mask removing step ST10, the multilayer substrate 30 having the communication flow path 31, the supply flow path 32, the inflow flow path 38, and the common liquid chamber 40 is obtained.

Thereafter, in order to protect the liquid flow path formed on the multilayer substrate 30 from the liquid, although not illustrated, a protective film forming step may be performed of forming a protective film on the front surface of the liquid flow path formed in the multilayer substrate 30. As the protective film, a material having liquid resistance such as ink resistance, for example, a material having alkali resistance such as tantalum oxide represented by $TaO_x$ can be used. The thickness of the protective film is not particularly limited, and can be set to approximately 30 to 70 nm.

In order to manufacture the liquid ejecting head 1 from the obtained multilayer substrate 30, for example, a pressure chamber substrate bonding step, a protective substrate bonding step, a case head bonding step, a nozzle plate bonding step, and a sealing plate bonding step are sufficient. In the pressure chamber substrate bonding step, a treatment is performed of bonding the pressure chamber substrate side surface 30*a* of the multilayer substrate 30 to the multilayer substrate side surface 10*b* of the pressure chamber substrate 10. In the protective substrate bonding step, a treatment is performed of bonding the protective substrate side surface 10*a* of the pressure chamber substrate 10 to the protective substrate 50. In the case head bonding step, a treatment is performed of bonding the pressure chamber substrate side surface 30*a* of the multilayer substrate 30 to the case head 70. In the nozzle plate bonding step, a treatment is performed of bonding the nozzle plate side surface 30*b* of the multilayer substrate 30 to the nozzle plate 80. In the sealing plate bonding step, a treatment is performed of bonding the nozzle plate side surface 30*b* of the multilayer substrate 30 to the sealing plate 90. These bonding can be performed using, for example, an adhesive.

By using the SOI substrate for forming the multilayer substrate 30, the projection portion 300 including the insulating layer 141 is formed in the communication flow path 31, the rigidity of the partition wall 31*a* of the communication flow path 31 is increased, and the crosstalk phenomenon is suppressed. Here, when bonding the substrate having the liquid flow path in the first flow path arrangement layer 131 to the substrate having the liquid flow path in the second flow path arrangement layer 132 with an adhesive, it is required to bond these substrates so that the mass of adhesive does not get mixed in the liquid flow path, and a treatment for managing the accuracy of the bonding position is required. By using the SOI substrate for forming the multilayer substrate 30, the possibility of the mass of adhesive being mixed in the liquid flow path is eliminated, the accuracy of the position of the liquid flow path is also improved, and the manufacturing cost is suppressed. Furthermore, since the projection portion 300 is aligned with the position of the insulating layer 141, the dimensional accuracy of the communication flow path 31 is improved, and the characteristics of the liquid ejecting head 1 ejecting the liquid droplet Q0 are more stabilized. In addition, by adjusting the position of the insulating layer 141 in the first direction D1, it is possible to dispose the projection portion 300 at a desired position.

Furthermore, since the first inclined portion 340 is present in the projection portion 300, the residual bubbles in the communication flow path 31 are suppressed, and even when the second inclined portion 350 of the projection portion 300 is present, the residual bubbles in the communication flow path 31 are suppressed.

As described above, according to the manufacturing method of this specific example, the liquid ejecting head is obtained that improves the discharge performance of the bubbles in the communication flow path while increasing the rigidity of the wall of the communication flow path. When the plurality of nozzles are arranged on the nozzle plate, the liquid ejecting head is obtained that improve the discharge performance of the bubbles in the communication flow path while suppressing the crosstalk phenomenon.

Various manufacturing methods for forming the projection portion 300 illustrated in FIG. 5 or the like are conceivable.

Figure 12:
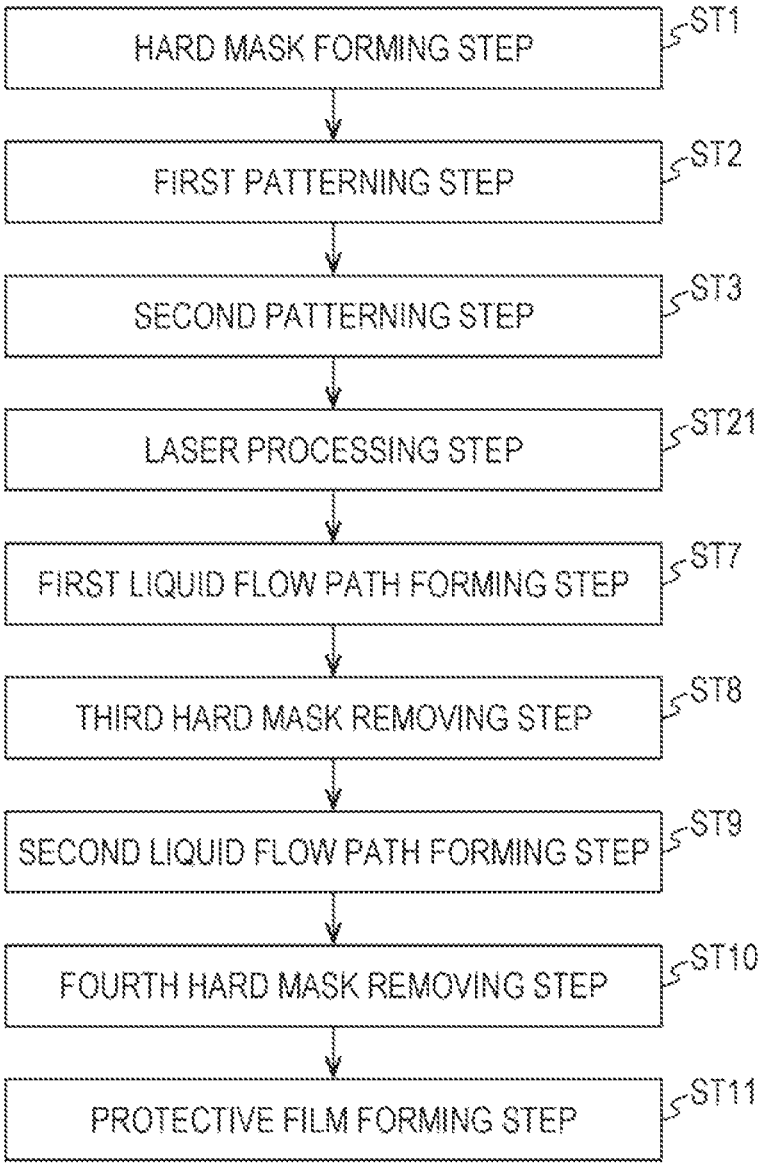
FIG. 12 is a view schematically illustrating another example of a manufacturing method.

For example, as in the manufacturing method illustrated in FIG. 12, the first prepared hole 153*a* and the second prepared hole 153*b* may be formed by laser. In the manufacturing method, the above-described steps ST4 to ST6 are replaced by a laser processing step ST21.

Figure 13:
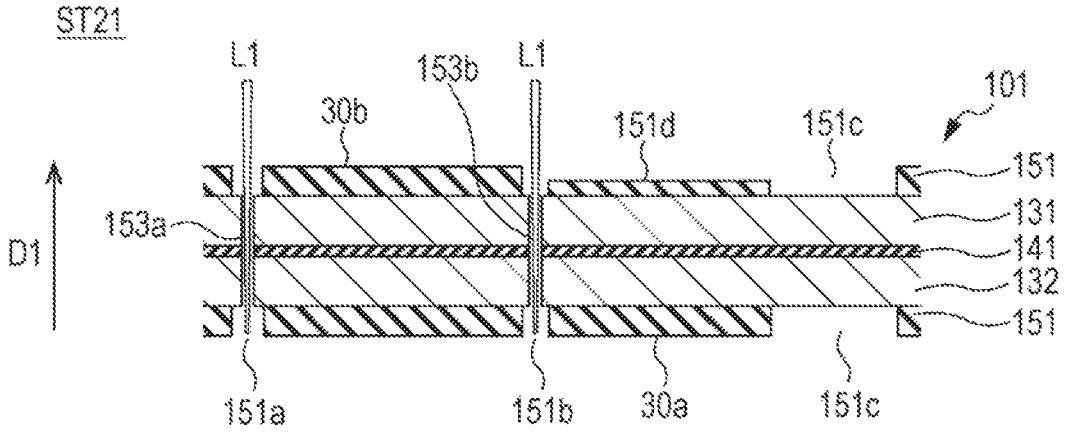
FIG. 13 is a cross-sectional view schematically illustrating another example of the manufacturing step.

The cross section of the substrate 101 being processed immediately after performing the above-described steps ST1 to ST3 is as illustrated in FIG. 8A. Thereafter, in the laser processing step ST21, as illustrated in FIG. 13, a treatment is performed of forming the first prepared hole 153*a* and the second prepared hole 153*b* penetrating the substrate 101 being processed by being irradiated with laser light L1 from one surface of the substrate 101 being processed. It may be irradiated with the laser light L1 onto the substrate 101 being processed from the pressure chamber substrate side surface 30*a* or irradiated with the laser light L1 onto the substrate 101 being processed from the nozzle plate side surface 30*b*. When the laser is used, the insulating layer 141 is also removed in the communication flow path corresponding region 151*a* and the supply flow path corresponding region 151*b*.

Thereafter, the multilayer substrate 30 as illustrated in FIG. 10B is formed by the above-described steps ST7 to ST10. In a protective film forming step ST11, a treatment may be performed of forming the protective film on the front surface of the liquid flow path formed in the multilayer substrate 30.

Figure 14:
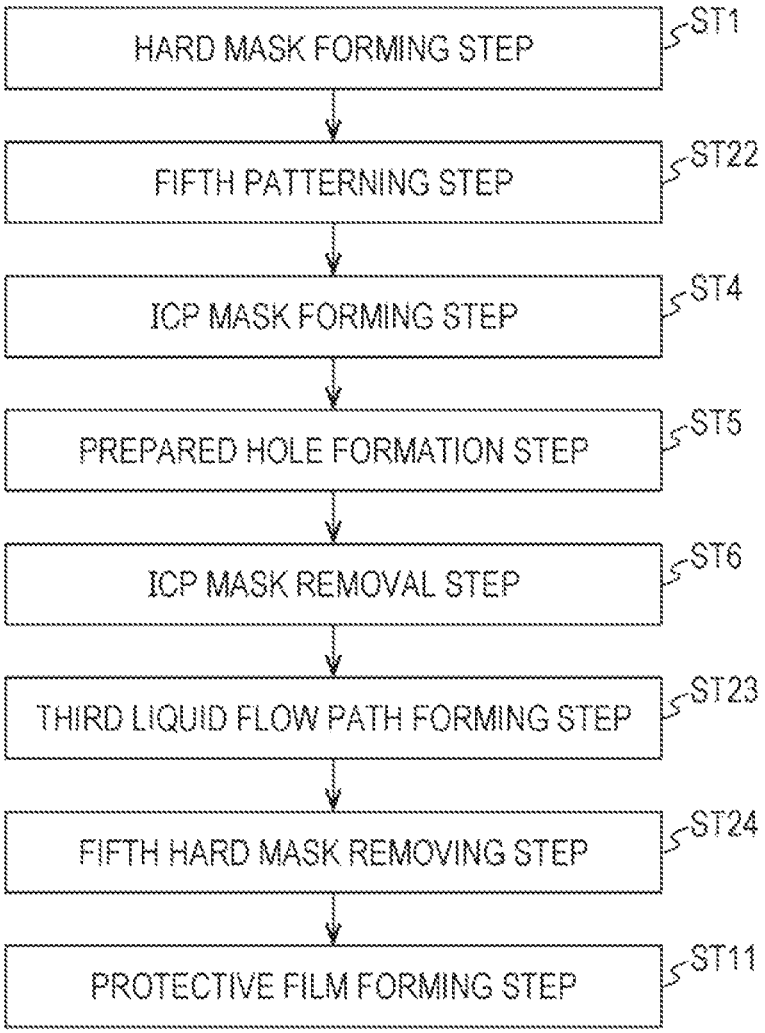
FIG. 14 is a view schematically illustrating another example of the manufacturing method.

In addition, as in the manufacturing method illustrated in FIG. 14, a treatment of removing the hard mask film in the common liquid chamber corresponding region 151*d* may be performed in a fifth patterning step ST22 after the hard mask forming step ST1. In the manufacturing method, the above-described steps ST2 and ST3 are replaced by the fifth patterning step ST22, and the above-described steps ST7 to ST10 are replaced by a third liquid flow path forming step ST23 and a fifth hard mask removing step ST24. In the example illustrated in FIG. 14, since there is no step of thinning the hard mask film 151, the hard mask film 151 can be thinned to 50 nm or the like, for example. Although not particularly limited, it is conceivable to form a hard mask film 151 made of silicon nitride on both surfaces of the base substrate 100 by reactive sputtering or the like.

Figure 15A:
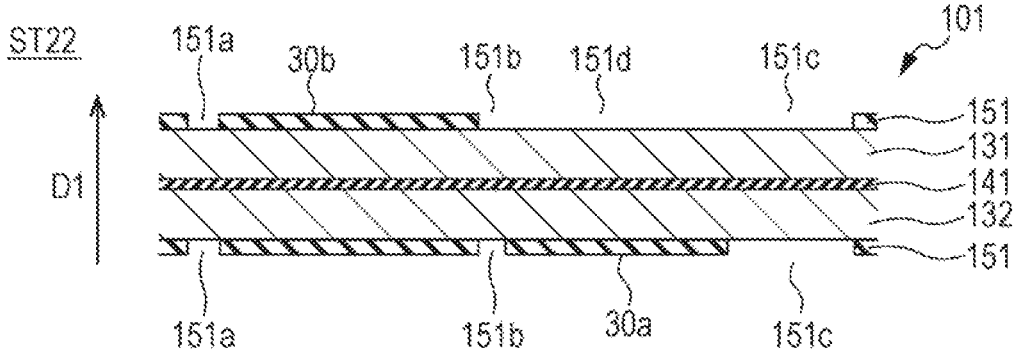
FIGS. 15A to 15C are cross-sectional views schematically illustrating another example of the manufacturing step.
Figure 15B:
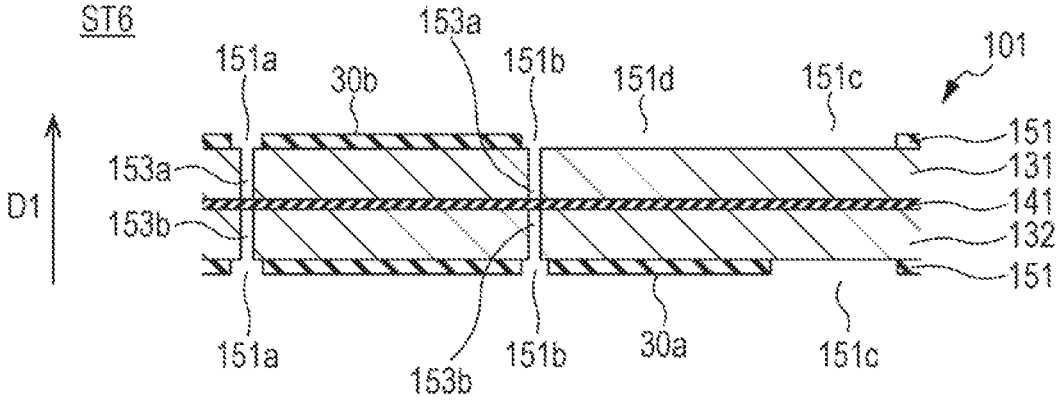

The cross section of the substrate 101 being processed immediately after the hard mask forming step ST1 is performed is as illustrated in FIG. 7B. Thereafter, in a fifth patterning step ST22, as illustrated in FIG. 15A, a treatment is performed of removing the hard mask film in the communication flow path corresponding region 151*a*, the supply flow path corresponding region 151*b*, the inflow flow path corresponding region 151*c*, and the common liquid chamber corresponding region 151*d* in the hard mask film 151. The fifth patterning step may include a fifth photoresist forming step, a fifth photoresist patterning step, a fifth hard mask removing step, and a fifth photoresist removing step. In the fifth photoresist forming step, a treatment of applying a photoresist on the hard mask film 151 is performed. In the fifth photoresist patterning step, a treatment is performed of removing the above-described regions 151*a*, 151*b*, 151*c*, and 151*d* of the photoresist by the exposure or the like. In the fifth hard mask removing step, a treatment is performed of removing the hard mask film 151 in a portion not covered with photoresist by wet etching, using an etchant for removing a portion of the hard mask film 151. In the fifth photoresist removing step, a treatment is performed of removing the fifth photoresist remaining on the hard mask film 151 with a solvent or the like.

Figure 15C:
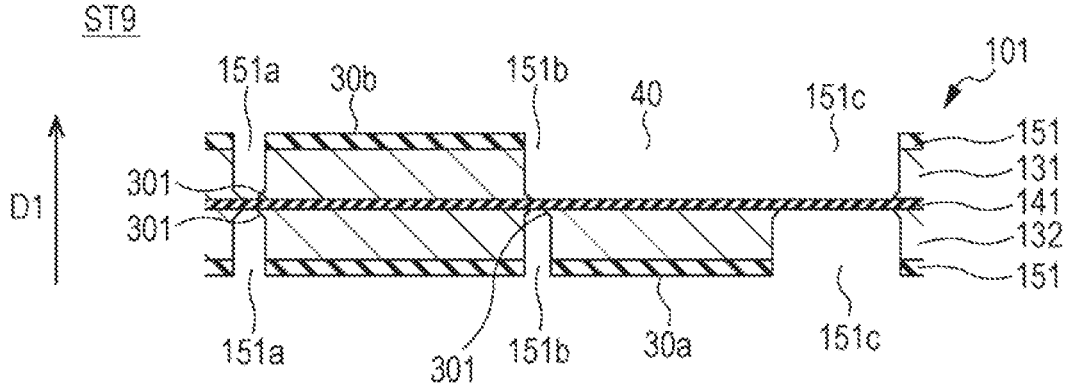

Thereafter, in the steps ST4 to ST6 described above, as illustrated in FIG. 15B, a treatment of forming the first prepared hole 153*a* and the second prepared hole 153*b* is performed. Next, in the third liquid flow path forming step ST23, as illustrated in FIG. 15C, a treatment is performed of removing the portions of the first flow path arrangement layer 131 and the second flow path arrangement layer 132 not covered with the hard mask film 151 by anisotropic wet etching, using an etchant for removing a portion of the first flow path arrangement layer 131 and the second flow path arrangement layer 132. By the anisotropic wet etching, the first prepared hole 153*a* and the second prepared hole 153*b* are thick. In addition, the first flow path arrangement layer 131 of the inflow flow path corresponding region 151*c* and the common liquid chamber corresponding region 151*d* among the first flow path arrangement layer 131 is removed until the first flow path arrangement layer 131 reach the insulating layer 141. Furthermore, the second flow path arrangement layer of the inflow flow path corresponding region 151*c* among the second flow path arrangement layer 132 is removed until the second flow path arrangement layer reaches the insulating layer 141. Next, in the fifth hard mask removing step ST24, a treatment is performed of removing the hard mask film 151 by wet etching, using an etchant for removing the hard mask film 151. As a result, as illustrated in FIG. 10B, the multilayer substrate 30 having the communication flow path 31, the supply flow path 32, the inflow flow path 38, and the common liquid chamber 40 is obtained. In the protective film forming step ST11, a treatment may be performed of forming the protective film on the front surface of the liquid flow path formed in the multilayer substrate 30.

In the manufacturing method illustrated in FIG. 14, since there is no step of thinning the hard mask film 151, the hard mask film 151 formed in the hard mask forming step ST1 can be thinned and the dimensional accuracy of the communication flow path 31, the supply flow path 32, and the like can be increased.

(5) SPECIFIC EXAMPLE OF LIQUID EJECTING APPARATUS

FIG. 16 illustrates the appearance of the liquid ejecting apparatus 200 having the above-described liquid ejecting head 1. The liquid ejecting apparatus 200 illustrated in FIG. 16 is an ink jet type recording apparatus, and is a serial printer. By incorporating the liquid ejecting head 1 into the recording head units 211 and 212, the liquid ejecting apparatus 200 is manufactured. The liquid ejecting head 1 is attached to each of the recording head units 211 and 212 illustrated in FIG. 16, and ink cartridges 221 and 222 for supplying an ink as a liquid Q1 to the liquid ejecting head 1 are detachably mounted. A carriage 203 on which the recording head units 211 and 212 are mounted can reciprocate along a carriage shaft 205 attached to an apparatus main body 204. When the driving force of a driving motor 206 is transmitted to the carriage 203 via a plurality of gears (not illustrated) and a timing belt 207, the carriage 203 moves along the carriage shaft 205. The print substrate 290 is transported onto a platen 208 by a paper feed roller (not illustrated) or the like. The liquid droplet Q0 ejected by the liquid ejecting head 1 supplied with the liquid Q1 from the ink cartridges 221 and 222 is landed on the print substrate 290 on the platen 208. As a result, a dot formed by the liquid droplet Q0 is formed on the print substrate 290, and a printing image represented by a plurality of dots is formed on the print substrate 290.

As matter of course, the ink jet type recording apparatus may be a line printer or the like having a line head in which a plurality of nozzles are arranged over the entire width of the print substrate.

(6) ANOTHER SPECIFIC EXAMPLE OF LIQUID EJECTING HEAD

Figure 17:
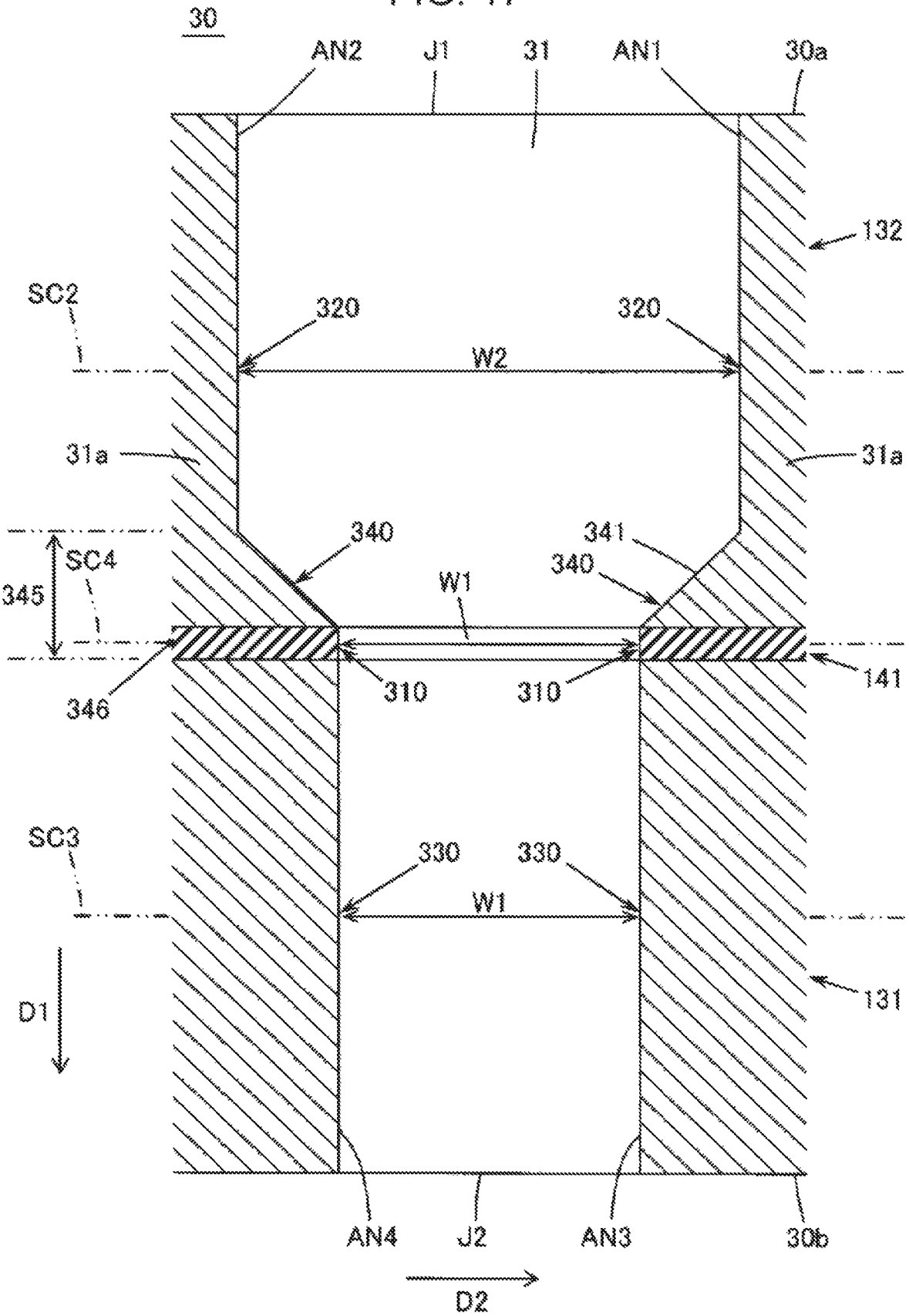
FIG. 17 is a view schematically illustrating another example of a cross section of the multilayer substrate.

FIG. 17 schematically illustrates another example of the first cross section SC1 of the multilayer substrate 30 at the position corresponding to XVII-XVII in FIG. 4. In the communication flow path 31 illustrated in FIG. 17, the width of the third portion 330 in the first flow path arrangement layer 131 is the same as the first width W1 in the first portion 310. For example, in the first patterning step ST2 illustrated in FIG. 7C, such a communication flow path 31 is formed by making the opening on the side of the nozzle plate side surface 30*b* smaller than the opening on the side of the pressure chamber substrate side 30*a* in the communication flow path corresponding region 151*a* of the hard mask film 151.

In the communication flow path 31 illustrated in FIG. 17, the first width W1 of the first portion 310 is narrower than the second width W2 of the second portion 320. In addition, the communication flow path 31 includes the first inclined portion 340 having the first wall surface 341 which is a (111) plane inclined to the first direction D1 between the first portion 310 and the second portion 320. The first inclined portion 340 has an inclination inside the communication flow path 31 as the first inclined portion 340 approaches the first portion 310.

As illustrated in FIG. 17, since the width of the first portion 310 including the insulating layer 141 is narrower than the width of the second portion 320 in the first cross section SC1 along the first direction D1 and the second direction D2, the rigidity of the partition wall 31*a* of the communication flow path 31 is increased, and the crosstalk phenomenon is suppressed. In addition, in the communication flow path 31, since there is the first inclined portion 340 that gradually narrows from the second portion 320 toward the first portion 310 having a narrow width, when the liquid Q1 flows in the first direction D1 in the communication flow path 31 at the time of cleaning or the like, the flow improves, and the bubbles are guided by the first inclined portion 340 to easily get over the first portion 310. Since the fourth cross section SC4 of the first portion 310 has a substantially hexagonal shape close to a circular shape as compared with the substantially parallelogram shape, the bubbles are likely to be discharged at the time of cleaning. Therefore, the residual bubbles in the communication flow path 31 are suppressed.

Figure 18:
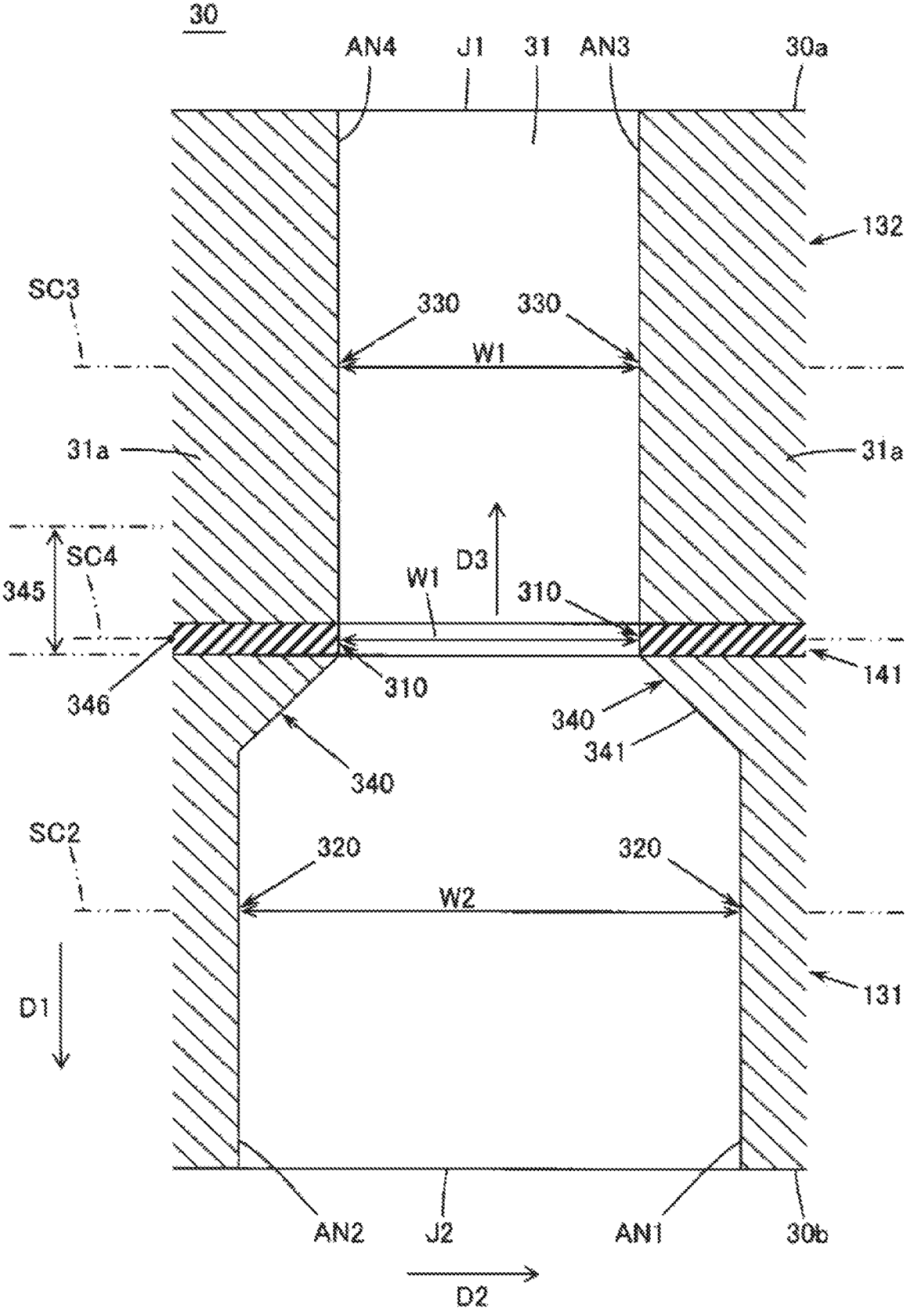
FIG. 18 is a view schematically illustrating another example of a cross section of the multilayer substrate.

FIG. 18 schematically illustrates still another example of the first cross section SC1 of the multilayer substrate 30 at the position corresponding to XVIII-XVIII in FIG. 4. In the example illustrated in FIG. 18, the second portion 320 is disposed in the first flow path arrangement layer 131, and the third portion 330 is disposed in the second flow path arrangement layer 132. The width of the third portion 330 in the second flow path arrangement layer 132 is the same as the first width W1 in the first portion 310. For example, in the first patterning step ST2 illustrated in FIG. 7C, such a communication flow path 31 is formed by making the opening on the side of the pressure chamber substrate side surface 30*a* smaller than the opening on the side of the nozzle plate side surface 30*b* in the communication flow path corresponding region 151*a* of the hard mask film 151.

In the communication flow path 31 illustrated in FIG. 18, the first width W1 of the first portion 310 is narrower than the second width W2 of the second portion 320. In addition, the communication flow path 31 includes the first inclined portion 340 having the first wall surface 341 which is a (111) plane inclined to the first direction D1 between the first portion 310 and the second portion 320. The first inclined portion 340 has an inclination inside the communication flow path 31 as the first inclined portion 340 approaches the first portion 310.

As illustrated in FIG. 18, since the width of the first portion 310 including the insulating layer 141 is narrower than the width of the second portion 320 in the first cross section SC1 along the first direction D1 and the second direction D2, the rigidity of the partition wall 31*a* in the communication flow path 31 is increased, and the crosstalk phenomenon is suppressed. In addition, since there is the first inclined portion 340 which gradually expands from the first portion 310 having a narrow width toward the second portion 320 in the communication flow path 31, when the liquid Q1 flows through the communication flow path 31 in the first direction D1 at the time of cleaning or the like, the liquid Q1 is unlikely to stagnate between the first portion 310 and the second portion 320, and the flow of the liquid Q1 improves. Since the fourth cross section SC4 of the first portion 310 has a substantially hexagonal shape close to a circular shape as compared with the substantially parallelogram shape, the bubbles are likely to be discharged at the time of cleaning. Therefore, the residual bubbles in the communication flow path 31 are further suppressed.

Figure 19:
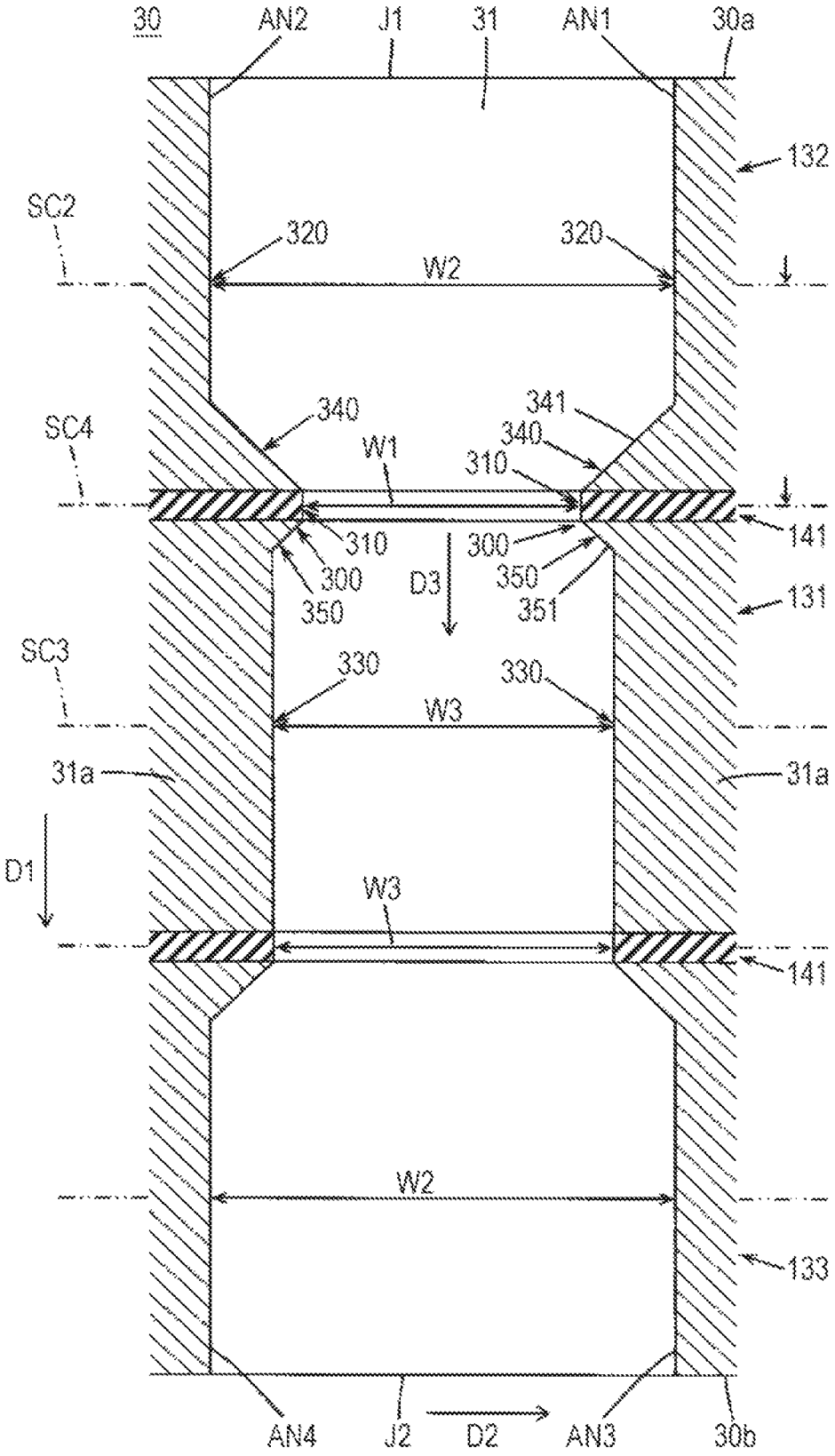
FIG. 19 is a view schematically illustrating another example of a cross section of the multilayer substrate.

FIG. 19 schematically illustrates the first cross section SC1 of the multilayer substrate 30 having a plurality of insulating layers 141. When the insulating layer 141 is disposed in two layers on the multilayer substrate 30 so as to divide the flow path arrangement layer of the multilayer substrate 30 into three layers, with any one of the insulating layers 141 as a reference, the flow path arrangement layer on the side of the nozzle plate 80 is the first flow path arrangement layer 131 and the flow path arrangement layer on the side of the pressure chamber substrate 10 is the second flow path arrangement layer 132. In FIG. 19, attention is paid to the insulating layer 141 closer to the pressure chamber substrate 10, it is illustrated that the third flow path arrangement layer 133, the insulating layer 141, the first flow path arrangement layer 131, the insulating layer 141, and the second flow path arrangement layer 132 are disposed in this order from the nozzle plate 80 side. In this case, the first portion 310 including the insulating layer 141 closer to the pressure chamber substrate 10 is the first width W1. In the example illustrated in FIG. 19, the second flow path arrangement layer 132 has the second portion 320 having the second width W2, and the first flow path arrangement layer 131 has the third portion 330 having a third width W3. The first width W1 is narrower than the second width W2 and narrower than the third width W3. The projection portion 300 including the first portion 310 having the first width W1 includes the first inclined portion 340 in the second flow path arrangement layer 132 and the second inclined portion 350 in the first flow path arrangement layer 131. The intermediate position of the communication flow path 31 in the first direction D1 is not included in the range of the projection portion 300 in the first direction D1 in the communication flow path 31.

In the example illustrated in FIG. 19, it is also possible to apply each layer of the multilayer substrate 30 to the first flow path arrangement layer 131, the insulating layer 141, the second flow path arrangement layer 132, the insulating layer 141, and the third flow path arrangement layer 133 in order of arrangement from the nozzle plate 80 side. In this case, a portion including the insulating layer 141 closer to the nozzle plate 80 is applied to the first portion 310, and the first flow path arrangement layer 131 has the second portion 320.

Since the portion where the width is narrowed according to each of the plurality of insulating layers 141 is in the communication flow path 31 of the multilayer substrate 30, the rigidity of the partition wall 31*a* of the communication flow path 31 is increased, and the crosstalk phenomenon is suppressed. Since the inclined portion coupled to the first portion 310 is in the communication flow path 31, the residual bubbles in the communication flow path 31 are suppressed. In addition, since the portion where the width is narrowed in accordance with each of the insulating layers 141 is disposed in the communication flow path 31, the drying of the liquid Q1 is suppressed, and the increase in viscosity of the liquid Q1 is suppressed.

The liquid ejecting head 1 of another example described above can also be used in the liquid ejecting apparatus 200 illustrated in FIG. 16. By incorporating the liquid ejecting head 1 into the recording head units 211 and 212, the liquid ejecting apparatus 200 is manufactured.

Figure 20:
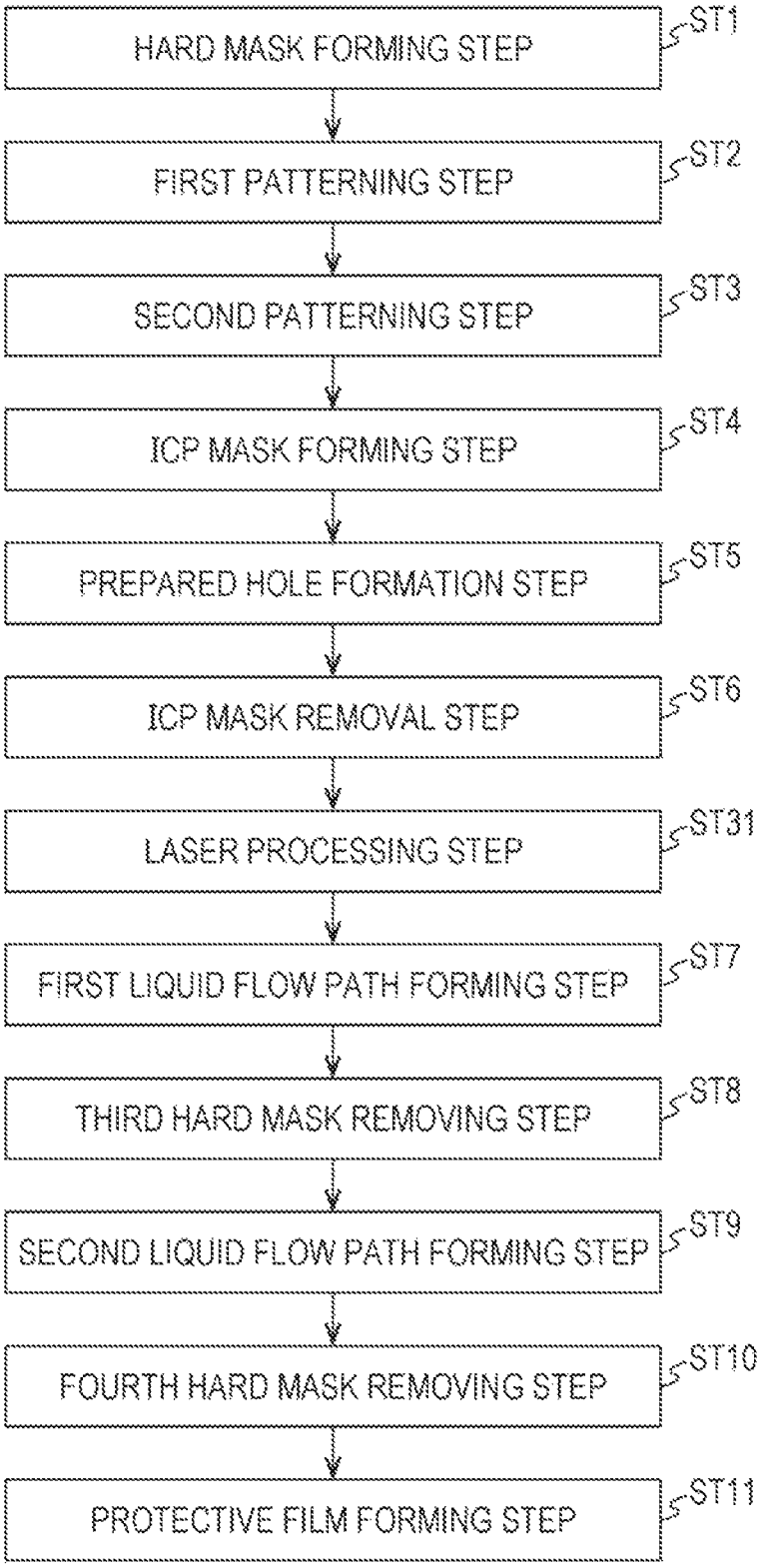
FIG. 20 is a view schematically illustrating another example of the manufacturing step.

FIG. 20 schematically illustrates a step of manufacturing the liquid ejecting head 1 when the multilayer substrate 30 having the liquid flow path has the plurality of insulating layers. In the manufacturing step illustrated in FIG. 20, a laser processing step ST31 is roughly added to the above-described steps ST1 to ST6 and ST7 to ST11. The details of the steps ST1 to ST6 and ST7 to ST11 illustrated in FIG. 20 are the same as the above-mentioned steps, so a detailed description will be omitted. FIGS. 21A, 21B, 22A, 22B, 23A, 23B, 24A, and 24B schematically illustrate the above-described method of forming the multilayer substrate 30. For the sake of convenience, a cross section of the substrate is illustrated at a position passing through the projection portion 300 in a positional relationship in which the multilayer substrate 30 illustrated in FIG. 19 is turned upside down. For the sake of clarity, elements appearing behind are omitted, and the ratio of the thickness of each layer may be different from the actual ratio. For convenience of description, an example is illustrated in which the first flow path arrangement layer 131, the insulating layer 141, the second flow path arrangement layer 132, a second insulating layer 142, and the third flow path arrangement layer 133 are applied in order of arrangement from the nozzle plate 80 side. Here, the second insulating layer 142 is an element of a name for convenience to distinguish it from the insulating layer 141 closer to the nozzle plate 80, and is an element that can be an insulating layer included in the first portion 310.

Figure 21A:
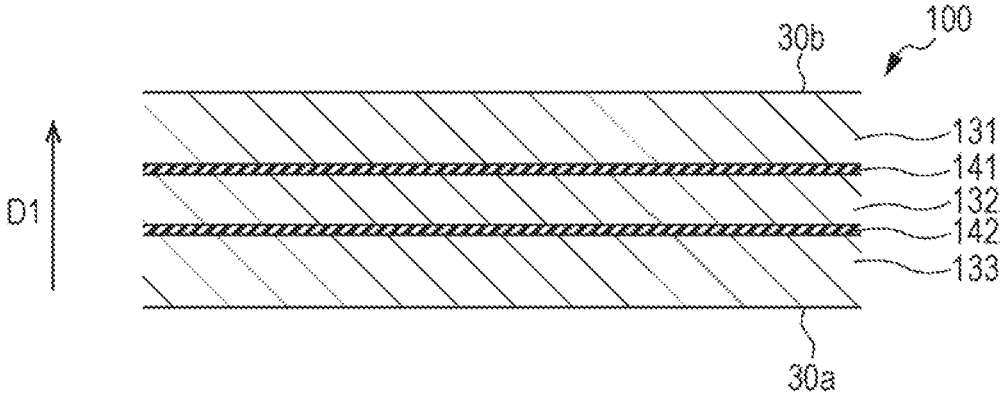
FIGS. 21A and 21B are cross-sectional views schematically illustrating another example of the manufacturing step.

FIG. 21A illustrates a cross section of the base substrate 100 for forming the multilayer substrate 30 having the liquid flow path. When the base substrate 100 is an SOI substrate, the first flow path arrangement layer 131, the second flow path arrangement layer 132, and the third flow path arrangement layer 133 are made of silicon, and the insulating layer 141 and the second insulating layer 142 are made of silicon oxide. The orientations of crystals of the first flow path arrangement layer 131, the second flow path arrangement layer 132, and the third flow path arrangement layer 133 are matched with each other. The nozzle plate side surface 30*b* which is the front surface of the first flow path arrangement layer 131 is a (110) plane, and the pressure chamber substrate side surface 30*a* which is the front surface of the third flow path arrangement layer 133 is also a (110) plane.

Figure 21B:
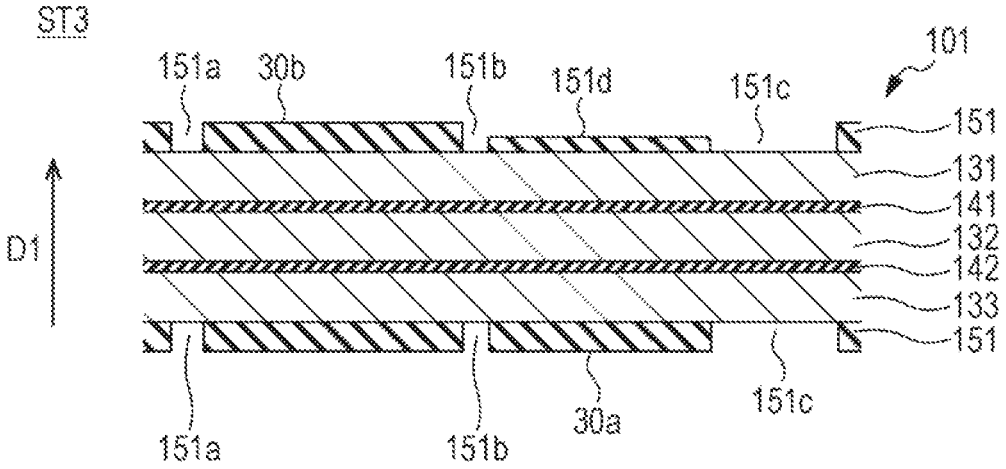

First, in the hard mask forming step ST1, a treatment is performed of forming a hard mask film 151 on the pressure chamber substrate side surface 30*a* and the nozzle plate side surface 30*b*, which are front surfaces of the base substrate 100. Next, in the first patterning step ST2, a treatment is performed of removing the hard mask film in the communication flow path corresponding region 151*a* corresponding to the communication flow path 31, the supply flow path corresponding region 151*b* corresponding to the supply flow path 32, and the inflow flow path corresponding region 151*c* corresponding to the inflow flow path 38 in the hard mask film 151. Next, in the second patterning step ST3, as illustrated in FIG. 21B, a treatment is performed of thinning the hard mask film in the common liquid chamber corresponding region 151*d* corresponding to the common liquid chamber 40 in the hard mask film 151.

Figure 22A:
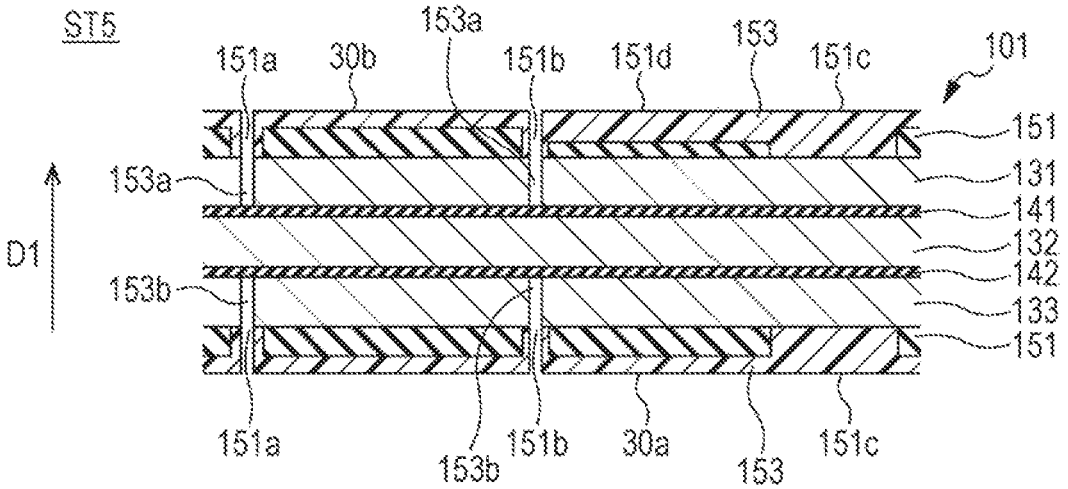
FIGS. 22A and 22B are cross-sectional views schematically illustrating another example of the manufacturing step.

Next, in the ICP mask forming step ST4, a treatment is performed of disposing the third photoresist 153 on a portion of the pressure chamber substrate side surface 30*a* and the nozzle plate side surface 30*b* which is the front surface of the substrate 101 being processed, except for the plurality of prepared holes. Next, in the prepared hole formation step ST5, as illustrated in FIG. 22A, a treatment is performed of forming the first prepared hole 153*a* and the second prepared hole 153*b* in the substrate 101 being processed. Here, the first prepared hole 153*a* reaching the insulating layer 141 is formed in the first flow path arrangement layer 131 from the nozzle plate side surface 30*b* of the substrate 101 being processed. The second prepared hole 153*b* reaching the second insulating layer 142 is formed in the third flow path arrangement layer 133 from the pressure chamber substrate side surface 30*a* of the substrate 101 being processed. Next, in the ICP mask removal step ST6, a treatment is performed of removing the third photoresist 153 remaining on both surfaces of the substrate 101 being processed with a solvent or the like.

Figure 22B:
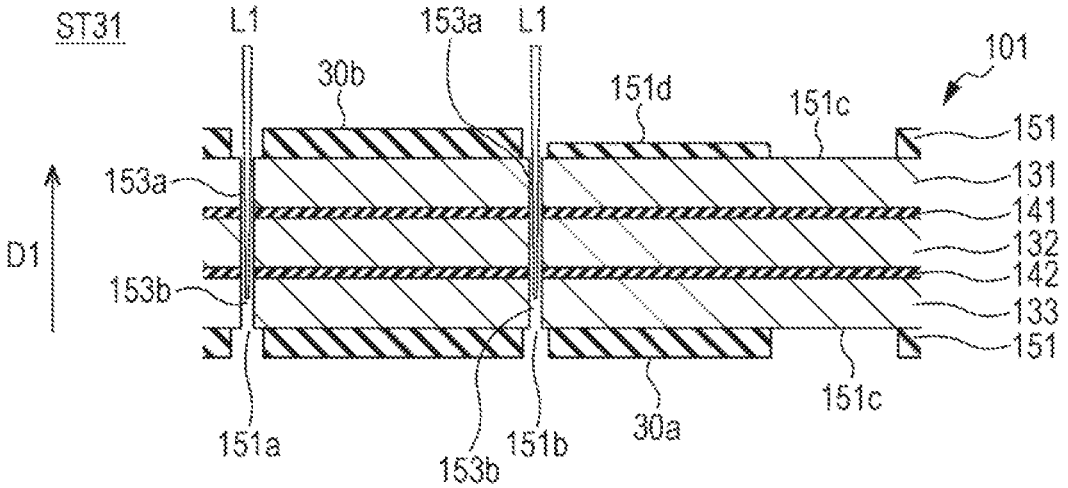

Between the first prepared hole 153*a* and the second prepared hole 153*b*, the insulating layer 141, the second flow path arrangement layer 132, and the second insulating layer 142 are left. Therefore, in the laser processing step ST31, as illustrated in FIG. 22B, a treatment is performed of penetrating between the first prepared hole 153*a* and the second prepared hole 153*b* by being irradiated with laser light L1 from one surface of the substrate 101 being processed. It may be irradiated with the laser light L1 onto the substrate 101 being processed from the pressure chamber substrate side surface 30*a* or irradiated with the laser light L1 from the nozzle plate side surface 30*b* onto the substrate 101 being processed.

Figure 23A:
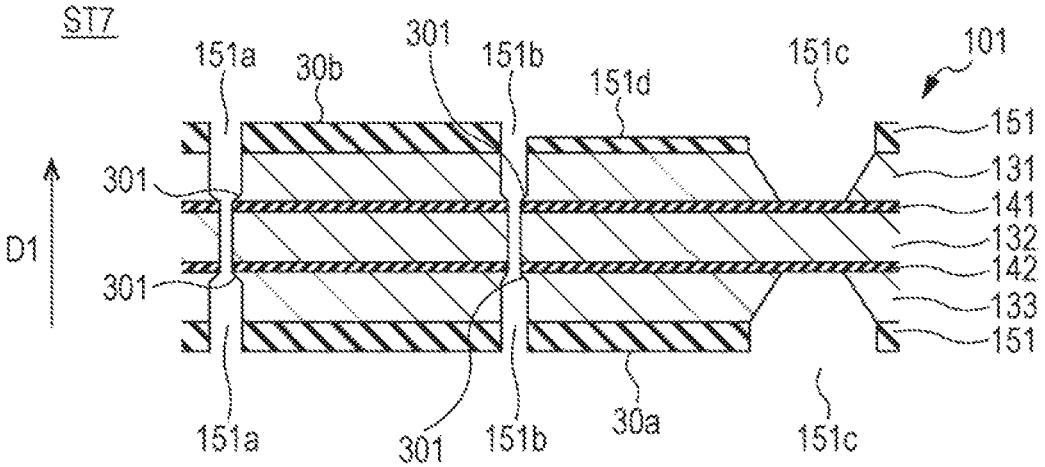
FIGS. 23A and 23B are cross-sectional views schematically illustrating another example of the manufacturing step.

Next, in the first liquid flow path forming step ST7, as illustrated in FIG. 23A, a treatment is performed of removing the first flow path arrangement layer 131 and the third flow path arrangement layer 133 in a portion not covered with the hard mask film 151 by an anisotropic wet etching using an etchant. The above-described etchant is a solution for removing a portion of the first flow path arrangement layer 131 and the third flow path arrangement layer 133. By the anisotropic wet etching, the first prepared hole 153*a* and the second prepared hole 153*b* become thick, and in the vicinity of the insulating layer 141 and the second insulating layer 142, the inclined surface 301 whose wall surface is the (111) plane is formed. In addition, in the inflow flow path corresponding region 151*c*, a recess reaching the insulating layer 141 is formed in the first flow path arrangement layer 131, and a recess reaching the second insulating layer 142 is formed in the third flow path arrangement layer 133.

Figure 23B:
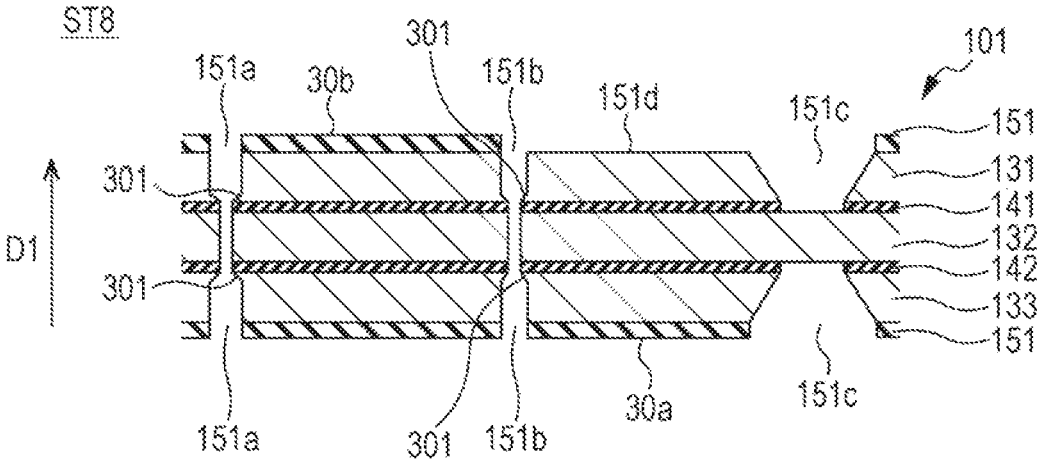

Next, in the third hard mask removing step ST8, as illustrated in FIG. 23B, a treatment is performed of removing a portion of the hard mask film 151 by wet etching, using an etchant for removing a portion of the hard mask film 151. Here, the portion of the hard mask film 151 in the common liquid chamber corresponding region 151*d* is removed by etching. In addition, in the third hard mask removing step ST8, a treatment is performed so as to remove a portion of the insulating layer 141 and the second insulating layer 142 in the inflow flow path corresponding region 151*c*.

Figure 24A:
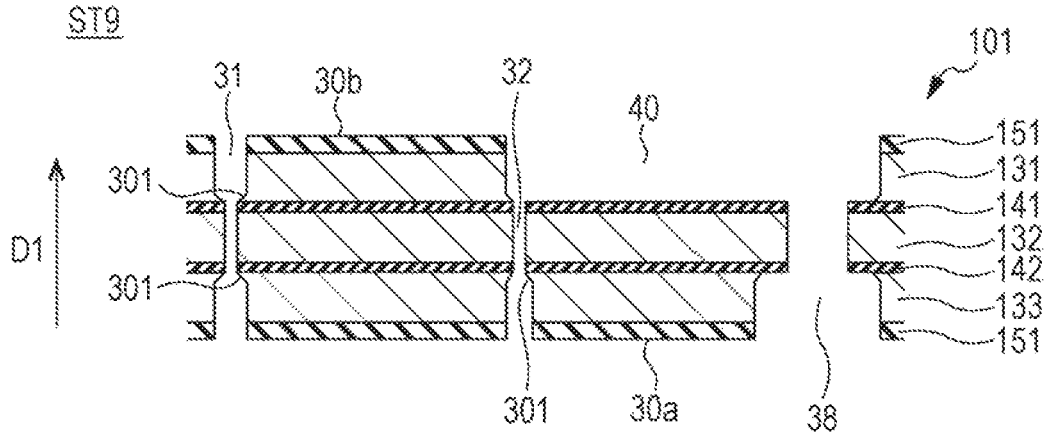
FIGS. 24A and 24B are cross-sectional views schematically illustrating another example of the manufacturing step.

Next, in the second liquid flow path forming step ST9, as illustrated in FIG. 24A, a treatment is performed of removing the first flow path arrangement layer 131, the second flow path arrangement layer 132, and the third flow path arrangement layer 133 in a portion not covered with the hard mask film 151, the insulating layer 141, and the second insulating layer 142 by an anisotropic wet etching using an etchant. The above-described etchant is a solution for removing a portion of the first flow path arrangement layer 131, the second flow path arrangement layer 132, and the third flow path arrangement layer 133. By the anisotropic wet etching, the first flow path arrangement layer of the first flow path arrangement layer 131 in the common liquid chamber corresponding region 151*d* is removed until the first flow path arrangement layer reaches the insulating layer 141, and the second flow path arrangement layer of the inflow flow path corresponding region 151*c* of the second flow path arrangement layer 132 is removed.

Figure 24B:
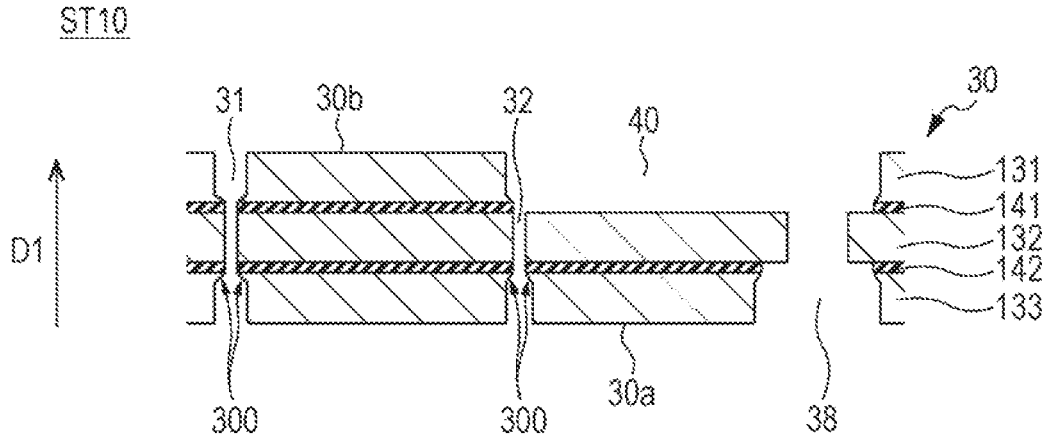

Next, in the fourth hard mask removing step ST10, as illustrated in FIG. 24B, a treatment is performed of removing the hard mask film 151 by wet etching, using an etchant for removing the hard mask film 151. Here, the insulating layer 141 exposed in the common liquid chamber corresponding region 151*d* and the inflow flow path corresponding region 151*c* is removed by etching. In addition, the second insulating layer 142 exposed in the inflow flow path corresponding region 151*c* is also removed by etching. By performing the fourth hard mask removing step ST10, the multilayer substrate 30 having the communication flow path 31, the supply flow path 32, the inflow path 38, and the common liquid chamber 40 is obtained. Thereafter, in the protective film forming step ST11, a treatment may be performed of forming a protective film on the front surface of the liquid flow path formed in the multilayer substrate 30.

According to the above-described manufacturing method, it is possible to obtain the liquid ejecting head capable of suppressing thickening of the liquid by improving discharge performance of the bubbles of the communication flow path while increasing the rigidity of the wall of the communication flow path.

(7) APPLICATION EXAMPLE AND MODIFICATION EXAMPLE

The present disclosure can be applied to various applications and various modifications.

For example, the liquid ejecting apparatus is not limited to a printing apparatus dedicated to printing, and may be a facsimile apparatus, a copying apparatus, a multifunction machine having a function other than printing such as facsimile or copying, or the like.

The liquid ejected from the fluid ejecting head includes a fluid such as a solution in which a solute such as a dye is dissolved in a solvent and a sol in which solid particles such as a pigment or a metal particle are dispersed in a dispersion medium. Such liquids include ink, liquid crystal, and the like. The liquid ejecting apparatus includes an apparatus for manufacturing a color filter for a liquid crystal display, an apparatus for manufacturing an electrode for an organic EL display, a biochip manufacturing apparatus, a manufacturing apparatus for forming wiring of a wiring substrate, and the like, in addition to the image recording apparatus such as a printer. Here, the organic EL is an abbreviation for organic electroluminescence.

In the above-described embodiment, the combination of the first portion 310 and the first inclined portion 340 is disposed at two positions in the second direction D2 in the communication flow path 31, and one of these combinations may be omitted. Even when there is only one combination of the first portion 310 and the first inclined portion 340 in the second direction D2 in the communication flow path 31, the effect of improving the discharge performance of the bubbles of the communication flow path can be obtained while increasing the rigidity of the wall of the communication flow path. When the plurality of nozzles are arranged on the nozzle plate, the effect of improving the discharge performance of the bubbles of the communication flow path can be obtained while suppressing the crosstalk phenomenon.

In the above-described embodiment, although the first wall surface 341 of the first inclined portion 340 and the second wall surface 351 of the second inclined portion 350 are (111) planes, even when the first wall surface 341 and the second wall surface 351 are deviated from the (111) plane, the effect of improving the discharge performance of the bubbles of the communication flow path can be obtained while increasing the rigidity of the wall of the communication flow path.

The first angle AN1, the second angle AN2, the third angle AN3, and the fourth angle AN4 for specifying the position of the first portion 310 are not limited to acute angles and may be right angles or obtuse angles. Even when the angles AN1, AN2, AN3, and AN4 are right angles or obtuse angles, the shape of the communication flow path 31 in the fourth cross section SC4 is close to a circle due to the existence of the first portion 310, and therefore the residual bubbles in the communication flow path 31 are further suppressed.

(8) ADDITIONAL ASPECTS

The present technology also has the following additional aspects. The parenthesis written in the additional aspect illustrates the reference numeral of the element corresponding to the above-described specific example. As matter of course, each element of the additional aspect is not limited to the specific example indicated by the reference numeral.

Additional Aspect 1

A manufacturing method of a flow path substrate (30) having the nozzle communication flow path 31 disposed between the nozzle plate 80 having the nozzle 81 and the pressure chamber substrate 10 having the pressure chamber 12 to allow the pressure chamber 12 and the nozzle 81 to communicate with each other, in which the base substrate 100 for forming the flow path substrate (30) includes the first flow path arrangement layer 131, the insulating layer 141 having a material different from a material forming the first flow path arrangement layer 131, and the second flow path arrangement layer 132 having a material different from a material forming the insulating layer 141, in order of arrangement from the nozzle plate 80 side, the direction from the pressure chamber substrate 10 to the nozzle plate 80 is defined as the first direction D1, and the direction intersecting the first direction D1 is defined as the second direction D2, the method includes a first forming step of forming the substrate 101 being processed having the prepared holes (153*a*, 153*b*) thinner than the communication flow path 31 in the region (151*a*) corresponding to the communication flow path 31 from the base substrate 100, and a second forming step of forming the first portion 310 having the first width W1 including the insulating layer 141, the second portion 320 having the second width W2 wider than the first width W1, and the first inclined portion 340 having the wall surface inclined to the first direction D1 between the first portion 310 and the second portion 320, in the first cross section SC1 along the first direction D1 and the second direction D2 of the communication flow path 31, by performing anisotropic wet etching on the substrate 101 being processed.

Here, the first forming step corresponds to steps ST1 to ST6 illustrated in FIGS. 7B, 7C, 8A to 8C, and 9A, steps ST1 to ST3 and ST21 illustrated in FIG. 12, steps ST1, ST22, and ST4 to ST6 illustrated in FIG. 14, steps ST1 to ST6, and ST31 illustrated in FIG. 20, and the like. The second forming step corresponds to steps ST7 to ST10 illustrated in FIGS. 9B, 9C, 10A and 10B, steps ST7 to ST10 illustrated in FIG. 12, steps ST23 and ST24 illustrated in FIG. 14, steps ST7 to ST10 illustrated in FIG. 20, and the like.

According to above Additional Aspect 1, it is possible to provide the flow path substrate for the liquid ejecting head that improves the discharge performance of the bubbles of the communication flow path while increasing the rigidity of the wall of the communication flow path.

Additional Aspect 2

A manufacturing method of a liquid ejecting head 1 including a pressure chamber substrate bonding step of bonding the pressure chamber substrate 10 to the front surface (30*a*) of the flow path substrate (30) on the side of the pressure chamber substrate 10 obtained by the manufacturing method according to Additional Aspect 1, and a nozzle plate bonding step of bonding the nozzle plate 80 to the front surface (30*b*) on the side of the nozzle plate 80 of the flow path substrate (30).

According to above Additional Aspect 2, it is possible to provide the liquid ejecting head that improves the discharge performance of the bubbles of the communication flow path while increasing the rigidity of the wall of the communication flow path.

Additional Aspect 3

A manufacturing method of a liquid ejecting apparatus 200, including a liquid ejecting head incorporating step of incorporating the liquid ejecting head obtained by the manufacturing method according to Additional Aspect 2 into the liquid ejecting apparatus 200.

According to above Additional Aspect 3, it is possible to provide the liquid ejecting apparatus including the liquid ejecting head that improves the discharge performance of the bubbles of the communication flow path while increasing the rigidity of the wall of the communication flow path.

(9) CONCLUSION

As described above, according to the present disclosure, it is possible to provide a technology such as the liquid ejecting head that improves the discharge performance of the bubbles of the communication flow path while increasing the rigidity of the wall of the communication flow path according to various aspects. As matter of course, the basic operation and effect described above can be obtained even with a technology formed only of the constituent features according to the independent aspect.

In addition, a configuration in which each of the configurations disclosed in the above examples are mutually replaced or the combination is changed, a configuration in which each of the configurations disclosed in the related art and the above examples are mutually replaced or the combination is changed, and the like can also be implemented. The present disclosure includes these configurations and the like.

What is claimed is:

1. A liquid ejecting head comprising:

a nozzle plate that includes a nozzle;

a multilayer substrate that includes a first flow path arrangement layer, an insulating layer having a material different from a material forming the first flow path arrangement layer, and a second flow path arrangement layer having a material different from a material forming the insulating layer in order of arrangement from a side of the nozzle plate, and that includes a communication flow path penetrating the first flow path arrangement layer, the insulating layer, and the second flow path arrangement layer; and a pressure chamber substrate that includes a pressure chamber communicating with the nozzle via the communication flow path, wherein when a direction from the pressure chamber substrate toward the nozzle plate is defined as a first direction, and a direction intersecting the first direction is defined as a second direction, the communication flow path includes a first portion having a first width and a second portion having a second width in a first cross section along the first direction and the second direction, the first width is narrower than the second width, the first portion includes the insulating layer, and the communication flow path includes at least one first inclined portion having a wall surface inclined to the first direction between the first portion and the second portion.

2. The liquid ejecting head according to claim 1, wherein the communication flow path includes a third portion in a direction opposite to the second portion from the first portion, a shape of the second portion in a second cross section orthogonal to the first direction has a first angle and a second angle facing the first angle, a shape of the third portion in a third cross section orthogonal to the first direction has a third angle corresponding to the first angle and a fourth angle corresponding to the second angle, and the at least one first inclined portion is disposed between the first angle and the third angle.

3. The liquid ejecting head according to claim 2, wherein the at least one first inclined portion includes first inclined portions, and the first inclined portions are arranged between the first angle and the third angle, and between the second angle and the fourth angle.

4. The liquid ejecting head according to claim 2, wherein the first angle, the second angle, the third angle, and the fourth angle are acute angles.

5. The liquid ejecting head according to claim 1, wherein the at least one first inclined portion is separated from a first coupling portion between the communication flow path and the pressure chamber, and is separated from a second coupling portion between the communication flow path and the nozzle.

6. The liquid ejecting head according to claim 1, wherein a range from the first portion to the at least one first inclined portion in the communication flow path includes an intermediate position in the first direction in the communication flow path.

7. The liquid ejecting head according to claim 1, wherein the first flow path arrangement layer and the second flow path arrangement layer are made of silicon, a plane index of a front surface of the multilayer substrate is (110), and a plane index of a wall surface of the at least one first inclined portion is (111).

8. The liquid ejecting head according to claim 1, wherein the communication flow path includes a third portion in a direction opposite to the second portion from the first portion, the first portion protrudes inside the communication flow path compared with the second portion and the third portion, and the communication flow path includes a second inclined portion having a wall surface inclined to the first direction between the first portion and the third portion.

9. The liquid ejecting head according to claim 1, wherein the pressure chamber substrate includes a vibration plate including a portion of a wall of the pressure chamber and a piezoelectric element disposed on the vibration plate.

10. A liquid ejecting apparatus comprising the liquid ejecting head according to claim 1.

* * * * *